US005502464A

United States Patent [19]

Takahashi et al.

[11] Patent Number: 5,502,464

[45] Date of Patent: Mar. 26, 1996

[54] FIXATER AND RECORDING APPARATUS USING THE SAME

[75] Inventors: Kazuyoshi Takahashi; Naoji Otsuka; Tokihide Ebata, all of Kawasaki; Hiromitsu Hirabayashi, Yokohama; Hiroshi Tajika, Yokohama; Noribumi Koitabashi, Yokohama; Atsushi Arai; Kenji Aono, both of Kawasaki; Hitoshi Sugimoto, Yokohama, all of Japan

[73] Assignee: Canon Kabushiki Kaisha, Tokyo, Japan

[21] Appl. No.: 358,993

[22] Filed: Dec. 19, 1994

Related U.S. Application Data

[63] Continuation of Ser. No. 766,063, Sep. 26, 1991, abandoned.

[30] Foreign Application Priority Data

| | | | |
|---|---|---|---|
| Sep. 27, 1990 | [JP] | Japan | 2-258326 |
| Sep. 27, 1990 | [JP] | Japan | 2-258327 |
| Sep. 28, 1990 | [JP] | Japan | 2-259161 |
| Sep. 28, 1990 | [JP] | Japan | 2-260232 |

[51] Int. Cl.[6] ..... B41J 2/01; B41J 29/00; B41J 2/17

[52] U.S. Cl. ..... 346/25; 346/134; 347/102; 347/108

[58] Field of Search ..... 346/25, 134; 347/102, 347/108; 219/216; 101/424.1, 487, 416.1, 488; 400/706, 708; 355/282–285

[56] References Cited

U.S. PATENT DOCUMENTS

| | | | |
|---|---|---|---|
| 4,566,014 | 1/1986 | Paranjpe et al. | 346/1.1 |
| 4,786,920 | 11/1988 | Igarashi | 346/134 |
| 4,900,173 | 2/1990 | Okamura | 346/134 X |
| 4,998,121 | 3/1991 | Koh et al. | 346/25 X |
| 5,130,726 | 7/1992 | Fukushima et al. | 346/140 R |

FOREIGN PATENT DOCUMENTS

| | | | |
|---|---|---|---|
| 0376346 | 7/1990 | European Pat. Off. . | |
| 0440262 | 8/1991 | European Pat. Off. . | |
| 0146073 | 6/1990 | Japan | 355/282 |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

A fixater has a fixing unit for expediting the fixation of an image recorded on a recording medium, a conveying unit for conveying the recording medium and a coupling unit detachably mountable in the mounting section of a cassette for stacking the recording medium for the recording apparatus. The fixater is mountable in place of the cassette for stacking the recording medium.

54 Claims, 23 Drawing Sheets

FIXATER AND RECORDING APPARATUS USING THE SAME

This application is a continuation of application Ser. No. 07/766,063 filed Sep. 26, 1991, now abandoned.

BACKGROUND OF THE INVENTION

1. Field of the Invention

The present invention relates to a recording apparatus for performing the recording by discharging ink onto a recording medium. More particularly, the present invention relates to a fixater for expediting the fixation of ink discharged on the recording medium, and a recording apparatus in which the aforesaid fixater can be mounted detachably.

2. Related Background Art

Traditionally, an image recording apparatus such as a printer, copying machine, or facsimile apparatus is provided with a recording unit to form an image on paper, thin plastic plate, and other recording media in accordance with image information.

The aforesaid image recording apparatus can be divided by the types of its recording head into those of an ink jet type, wire dot type, thermal type, laser beam type, and others.

Of those types mentioned above, the ink jet type has, particularly, the advantage that a highly precise image can be recorded at high speeds because with this type, ink is discharged from its recording head onto a recording medium, and that not only the recording is performed with less noise but a color image is easily recorded with the use of multicolor ink because the non-impact system is adopted for this type.

Particularly for the ink jet type image recording apparatus among those image recording apparatuses mentioned above, fixating means for expediting the fixation of the recorded image is provided in consideration of the recording on a recording medium having a slow ink fixation rate such as an OHP sheet.

FIGS. 1A to 1G are views schematically showing the operational principle of the recording head for a preferred ink jet recording apparatus.

In FIGS. 1A to 1G, there is formed in a recording head 50 an ink pass or passage 51 which is connected to a liquid chamber (not shown) in which ink is temporarily stored, and the leading end of the aforesaid ink pass 51 is opened to the face plane (the plane facing the recording medium with a predetermined space) 52 of the recording head 50 to form a discharging port 53.

In the aforesaid ink pass 51, ink (recording liquid) 54 is filled. Also, on the inner wall in the vicinity of the discharging port 54 of the aforesaid ink pass 51, a heater (electrothermal converter) 55 is provided.

The aforesaid heater 55 is connected to an electrode 56 for energizing.

FIG. 1A illustrates a state before the heater is energized. When the heater 55 is energized in response to an applied signal, the aforesaid heater 55 is caused to generate heat, so that ink 54 in the vicinity of the area in contact with the heater is rapidly heated (FIG. 1B).

By this heating, a rapid vaporization occurs in the ink 54 (FIG. 1C), and a bubble 57 is formed.

By the growth (expansion) of this bubble 57, ink is pressurized to cause it to be expansively projected from the discharging port 53 (FIG. 1D).

If the boundary between the bubble 57 and ink 54 is cooled at the time of the ink having been expansively projected sufficiently from the discharging port 53 (FIG. 1E), the expansively projected ink is discharged from the discharging port 53 as an ink droplet 58 and at the same time, the expanded bubble 57 is contracted (FIG. 1F).

FIG. 1G illustrates a state that an ink droplet has been formed in an appropriate amount for flight towards the recording medium and that the bubble in the ink pass 51 has disappeared simultaneously.

Thus, the ink droplet is caused to adhere to the recording medium to form a dot (perform a recording), and further the next discharging operation (recording operation) is prepared.

FIG. 2 is a partially perspective view schematically showing the discharging unit (recording unit) 40 of the aforesaid recording head 10.

In FIG. 2, a plurality of discharging ports 42 are formed at predetermined pitches on the discharging port surface 41 opposite to the recording medium 12 with a predetermined space (for example, approximately 0.5–2.0) between them, and an electrothermal converter (exothermic resistor and the like) 45 is arranged along the wall of each liquid pass or passage 44 which communicatively connects a common liquid chamber 43 and each discharging port 42.

FIG. 3 is a partially perspective view schematically showing the structure of the ink discharging unit of the recording head 10 in FIG. 2.

In FIG. 3, a plurality of electrothermal converters 22 and the wirings with respect thereto are formed by the same processes as fabricating semiconductors (thin film formation method or the like) on the substrate 21 of the recording head 10 through a thin film layer 23.

The aforesaid electrothermal converters 22 are arranged as shown in FIG. 3 at the positions with respect to the discharging ports and liquid passages which will be described later.

To the aforesaid substrate 21 (on the thin film 23 of the substrate 21), there is joined a liquid pass or passage formation member 24 having a plurality of liquid pass or passage walls 24A produced in parallel at the bottom face thereof at predetermined intervals.

Further, a ceiling plate 25 is joined to the upper face of the aforesaid liquid pass formation member 24.

Liquid passes or passages 26 are produced between each of the aforesaid liquid pass walls 24A, and the aforesaid liquid pass formation member 24 is joined in such a way that each of the aforesaid electrothermal converters 22 is positioned with a positional relationship in each of the liquid passes 26 so as to arrange each of them at a predetermined position therein.

Each of the aforesaid liquid pass walls 24A has a predetermined length, and the rear end of each liquid pass 26 is comunicatively connected with the common liquid chamber 27 produced between the aforesaid liquid pass formation member 24 and the substrate 21 (or the thin film 23).

Meanwhile, the other end (the leading end) of each liquid pass 26 is opened as a discharging port 29 respectively in the discharging port surface (face plane) 28 of the recording head 10.

Thus, the ink jet recording head is constructed to enable ink in the liquid pass 26 to be film boiled by the heat which is generated by energizing (by applying pulse voltage to) the exothermic resistor and the like constituting the electrothermal converter 22 thereby to cause the ink droplet to be discharged from the discharging port 29 by the variation of pressure thus created at that time.

According to the recording method set forth above, the fixing capability of the ink which has adhered to the recording medium depends greatly on the water absorptivity and other characteristics of the aforesaid recording medium.

For example, the fixing capability of ink differs when the aforesaid recording medium is an ordinary paper or some other usual recording sheet as opposed to when an OHP (overhead projector) sheet whose water absorptivity is inferior is used as a recording medium.

In other words, in the case of the ordinary sheet used, the ink is rapidly absorbed and there is no need for a particular fixing means for a recording without any difficulty. In the case of the OHP sheet, however, it is necessary to give a certain time (several minutes, for example) for the fixation of ink due to its inferior water absorptivity or it may be required to use a heating means or some other means to dry ink quickly.

Under the circumstances, there has been proposed an installation of a heat-drying type fixater particularly for an ink jet recording apparatus.

FIG. 4 is a schematic side view showing a structural example of the fixing means for a conventional image recording apparatus.

In FIG. 4, the fixing means for the conventional image recording apparatus is structured with the arrangement of a heater 61 for the ink fixation on the reverse side of a platen 62 of its recording unit to heat the recorded recording medium 67 by the aforesaid heater for the ink fixation, so that the recorded image is not smeared even if the recording surface is touched by a finger at the time of the recording medium P having been exhausted.

In the conventional recording apparatus, however, there exist the technical problems given below.

i) In a recording apparatus in which a fixater is incorporated, the fixater is permanently installed for an OHP sheet for which the apparatus is not used often, leading to the larger size of the apparatus, and the increase of the manufacturing cost and power consumption. Therefore, for those users who do not use an OHP sheet, this type of fixater is redundant.

ii) For the conventional recording apparatus using a detachable fixater, it is necessary for the user to attach the fixater to or detach it from the apparatus depending on whether an ordinary paper is used or an OHP sheet is used for recording, and the user finds it rather troublesome in handling the fixater each time as required.

iii) Sometimes a user wishes to use his apparatus for recording an OHP sheet even when he does not have a fixater which is available as an option to his apparatus. In such a case, it is difficult for him to cope with the situation.

Also, there are problems such as given below if a paper is handled for recording in a state where the fixater is installed in the apparatus.

A) Deterioration of paper quality and degradation of image quality.

B) Sheet jamming and other troubles occurring in the fixater when the paper is fed due to the different properties of the sheet and OHP sheet for transportability.

C) Further, in a structure such as shown in FIG. 4, the ink recorded on an OHP sheet is evaporated by heat of the heater 61, and the discharging port 66*a* of the recording head 66 may sometimes be moisturized when exposed to the water vapor emitted therefrom, lowering the recording quality or sometimes, causing drawback such as a disabled recording.

Furthermore, in an ink jet recording apparatus with a conventional fixater mounted therein, the driving condition of the fixater, conveying velocity of the recording medium, the amount of ink to be discharged and other prerequisites are defined to equalize the drying effect of ink fixation on the recorded recording medium, thus making it impossible to provide a compact and inexpensive ink jet recording apparatus, being also capable of drying the rear portion of the recording medium sufficiently at the same time.

SUMMARY OF THE INVENTION

The present invention is designed in consideration of these technical problems and the object of the present invention is to provide a fixater capable of expediting fixation reliability without making the size of the main body of the image recording apparatus large and increasing its manufacturing cost even in the case of using a recording medium which needs the fixation and furthermore, capable of eliminating any possible degradation of the recording quality caused by moisture generated on the recording head or the like, and a recording apparatus using the aforesaid fixater.

Also, another object of the present invention is to provide a recording apparatus capable of performing the recording on an OHP sheet irrespective of the presence of a fixing means mounted therein while there being no need of waiting for the recorded image to be dried if a fixater is provided, and such apparatus being capable of executing the required process most advantageously in either case.

Also, another object of the present invention is to provide a formation apparatus capable of avoiding any unnecessary increase of manufacturing cost and at the same time, being capable of preventing any possible deterioration of paper quality and image quality as well as a paper jamming to be caused by the difference between the paper and OHP sheet.

Still another object of the present invention is to provide a recording apparatus capable of performing ink fixation reliably over the entire area of a recording medium including its rear portion while saving the energy consumption.

A further object of the present invention is to provide a fixater which has a fixing unit for expediting the fixation of an image recorded on a recording medium, a conveying unit for conveying the recording medium, and a coupling unit detachably mountable in the mounting section of a cassette for stacking the recording medium for the recording apparatus, and is mountable in place of the cassette for stacking the recording medium.

Still a further object of the present invention is to provide a recording apparatus which has a recording unit for performing the recording on a recording medium with a recording head, and a conveying unit for conveying the recording medium, and further has the mounting section of a cassette for stacking the recording medium in which a fixater can be mounted detachably.

Still a further object of the present invention is to provide a recording apparatus which has a recording unit for performing the recording on a recording medium, a conveying unit for conveying the recording medium, and a mounting section for mounting detachably a fixater for expediting the fixation of the image recorded on the recording medium and a stacking unit for stacking the recording medium.

Still a further object of the present invention is to provide a recording apparatus which has a recording unit for performing the recording on a recording medium by discharging ink onto a recording medium, a conveying unit for conveying the recording medium, a mounting section for mounting detachably a fixater having a fixing unit for expediting the fixation of the ink recorded on the recording medium, a conveying unit for conveying the recording medium for fixation, and a coupling unit detachably mountable in the mounting section of the recording unit, a first sensor for outputting the result of the detection by detecting whether or not the fixater is mounted in the recording apparatus, a second sensor for outputting the result of the discrimination by discriminating whether or not the recording medium is an OHP sheet, and a control unit for determining in accordance with the outputs of the first sensor and the second sensor whether or not the recording should be performed on the basis of whether or not the recording medium is an OHP sheet.

Still a further object of the present invention is to provide a recording apparatus which has a recording unit for performing the recording on a recording medium by discharging ink onto a recording medium, a conveying unit for conveying the recording medium, a mounting section for mounting detachably a fixater having a fixing unit for expediting the fixation of the ink recorded on the recording medium, a conveying unit for conveying the recording medium for fixation, and a coupling unit detachably moutable in the mounting section of the recording unit, a first sensor for outputting the result of the detection by detecting whether or not the fixater is mounted in the recording apparatus, a second sensor for outputting the result of the discrimination by discriminating whether or not the recording medium is an OHP sheet, and a control unit for judging the performance of the recording irrespective of the presence of the fixater even in the case where the recording medium is not an OHP sheet on the basis of the outputs from the first sensor and the second sensor.

Still a further object of the present invention is to provide a recording apparatus which has a recording unit for performing the recording on a recording medium by discharging ink onto a recording medium, a conveying unit for conveying the recording medium, a mounting section for mounting detachably a fixater having a fixing unit for expediting the fixation of the ink recorded on the recording medium, a conveying unit for conveying the recording medium for fixation, and a coupling unit detachably mountable in the mounting section of the recording unit, a first sensor for outputting the result of the detection by detecting whether or not the fixater is mounted in the recording apparatus, a second sensor for outputting the result of the discrimination by discriminating whether or not the recording medium is an OHP sheet, a third sensor for outputting the result of he detection by detecting the rear portion of the recording medium, and a control unit for controlling the driving conditions of the fixater on the basis of the outputs from the first sensor, the second sensor, and the third sensor so as to enhance the fixation efficiency of the fixater.

DETAILED DESCRIPTION OF THE PREFERRED EMBODIMENTS

Hereinafter, in reference to the accompanying drawings, the embodiments according to the present invention will be described.

Figure 1A:
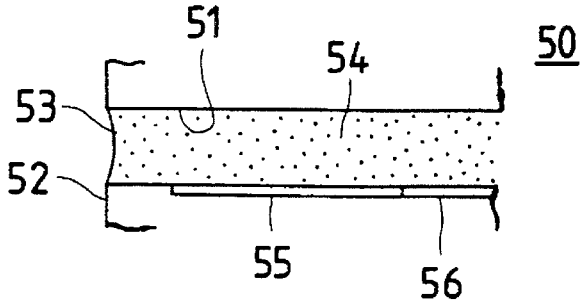
FIGS. 1A to 1G are views schematically showing the principle of the ink discharging of an ink jet recording head using an electrothermal converter.
Figure 1B:
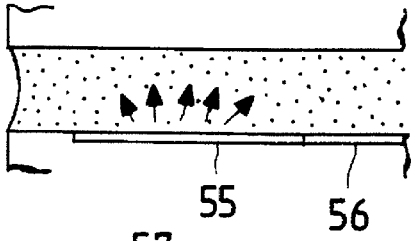
Figure 1C:
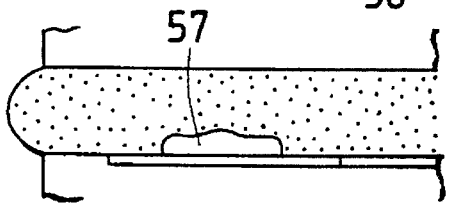
Figure 1D:
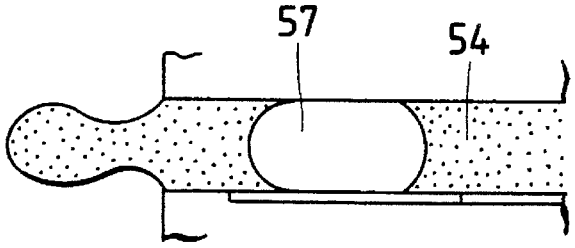
Figure 1E:
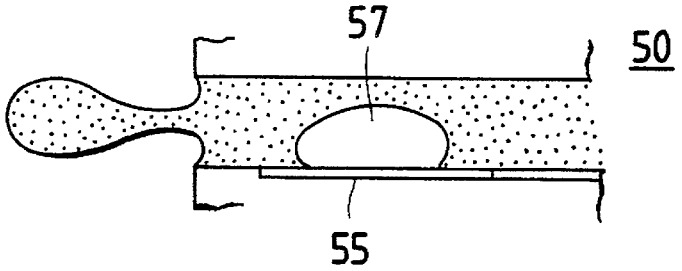
Figure 1F:
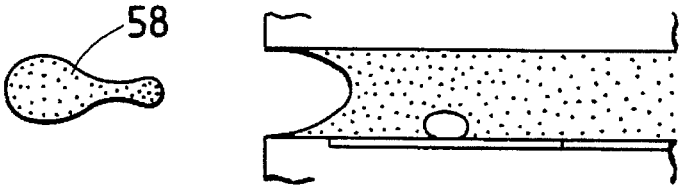
Figure 1G:
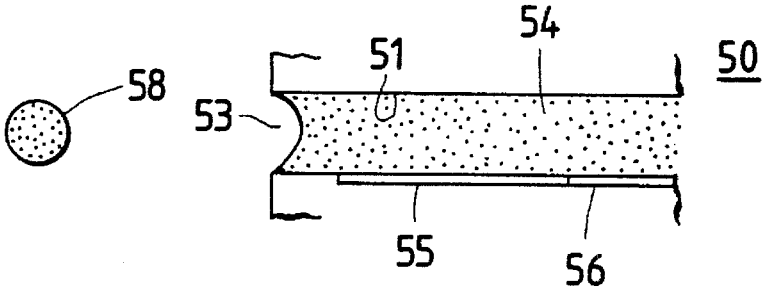
Figure 2:
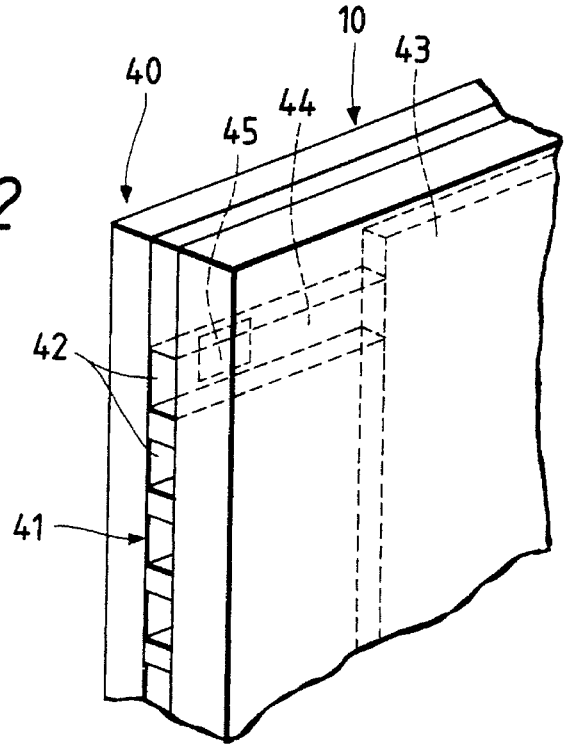
FIG. 2 is a partially perspective view schematically showing the structure of the recording unit of the recording head shown in FIG. 1.
Figure 3:
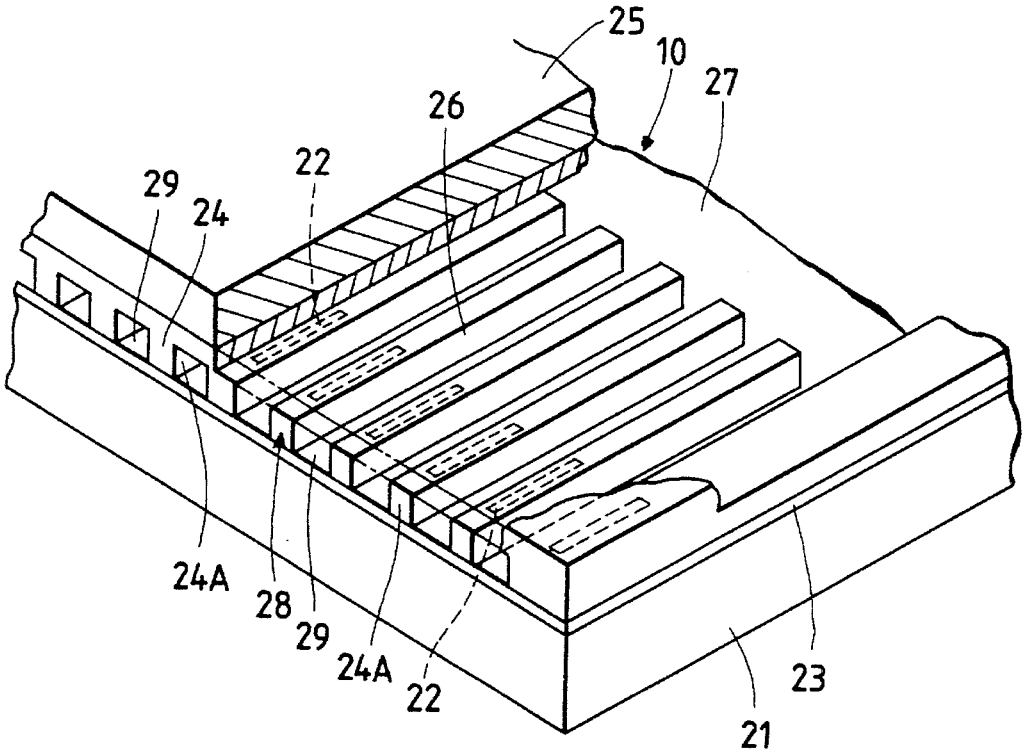
FIG. 3 is a partially cutaway perspective view showing the ink discharging unit of he recording head shown in FIG. 1.
Figure 4:
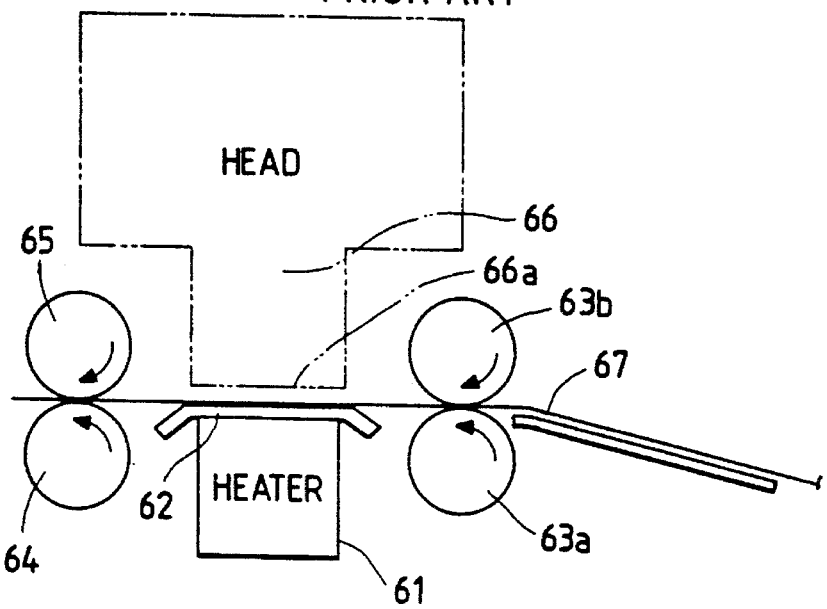
FIG. 4 PRIOR ART
FIG. 4 is a side view schematically showing an example of the fixater of a conventional image recording apparatus.
Figure 5:
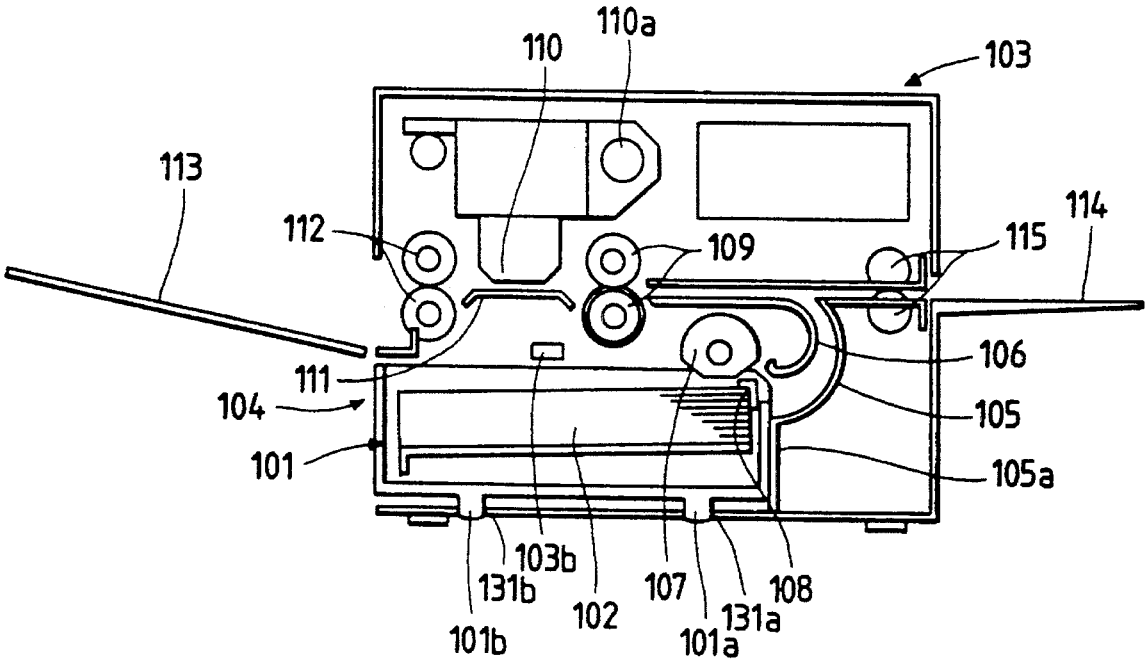
FIG. 5 is a vertically sectional view illustrating a state where a cassette for stacking the recording medium is mounted in an image recording apparatus.

FIG. 5 is a vertically sectional view showing an example of an image recording apparatus embodying the present invention as an embodiment according to the present invention.

In FIG. 5, a detachably mountable cassette 101 for stacking a recording medium is set in an image recording apparatus 103 by inserting the cassette therein until it hits the lower portion 105*a* of the recording medium guide 105 from the mounting section 104 of the image recording apparatus 103.

The recording medium 102 stacked in the cassette 101 for stacking the recording medium is separated one by one by a separation nail 108 when a paper feed roller 107 is rotated and is supplied to a pair of sub-scanning rollers 109 between the guide 105 and a guide 106.

This recording medium 102 is fed by the pair of the sub-scanning rollers 109 intermittently by a recording width along the surface of a platen 111.

At a position facing the platen 111, there is provided a recording head 110 which is reciprocated in the width direction of the recording medium 102 along a guide rail 110*a*, and the recording is performed for each recording width by discharging ink from the aforesaid recording head 110 in response to image signals. The recording medium thus recorded is exhausted sequentially by a pair of paper exhaust rollers 112 onto an exhaust sheet tray 113.

The OHP sheet and others which are not suited for the cassette sheet feeding or the recording medium which cannot be stacked in the cassette 101 are inserted from the manual insertion tray 114 and is supplied to the pair of subscanning rollers 109 by a pair of feed rollers 115 for the manual insertion. Thereafter, the recording is performed in the same procedures for the recording medium supplied from the aforesaid cassette 101, and the recording medium 102 thus recorded is exhausted onto the exhaust paper tray 113.

In this respect, the aforesaid recording head 110 is an ink jet recording head which discharges ink by utilizing thermal energy and is provided with the electrothermal converter for generating the thermal energy.

Also, the aforesaid ink jet recording head 110 performs the recording by discharging ink from the discharging port by utilizing the change of state resulting from the growth and contraction of bubble caused by the film boiling generated by the thermal energy applied by the electrothermal converter.

Figure 6:
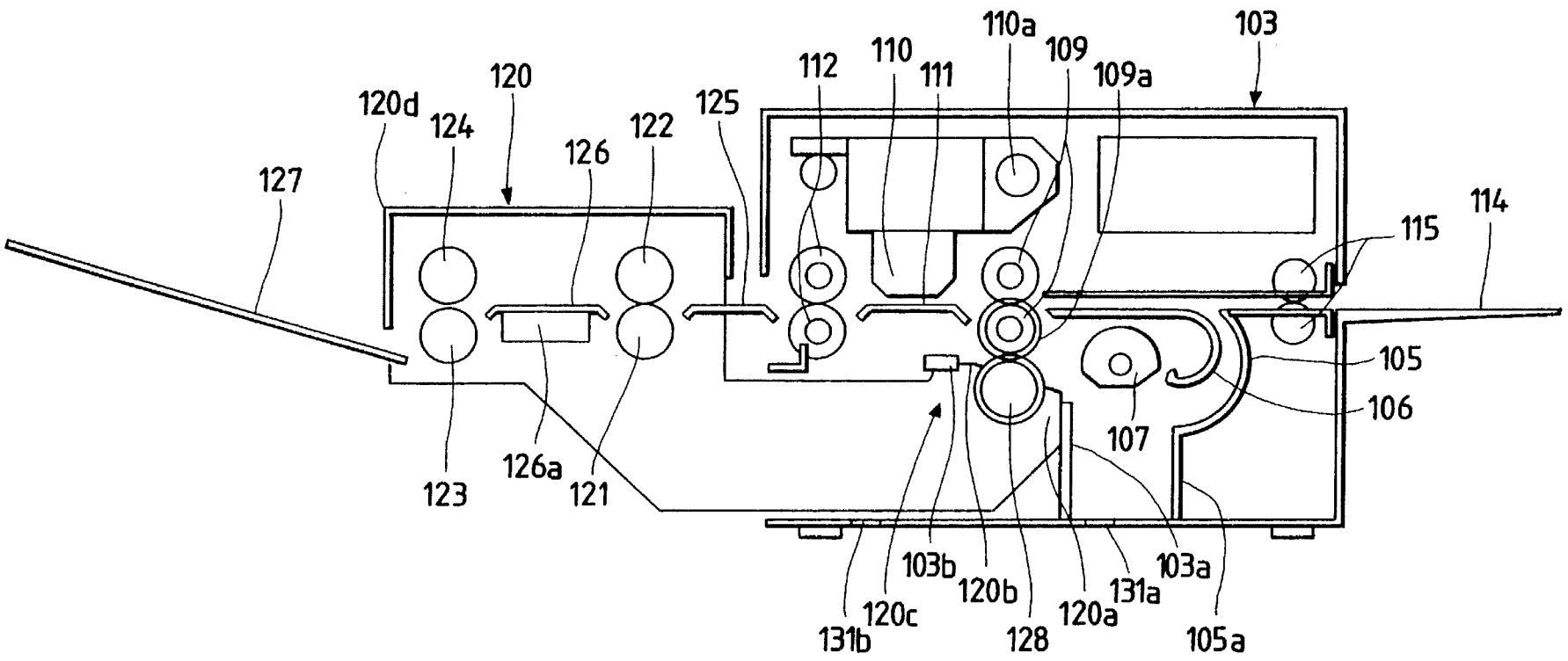
FIG. 6 is a vertically sectional view schematically showing a first example embodying the image recording apparatus in which a fixater according to the embodiment of the present invention is mounted.
Figure 8:
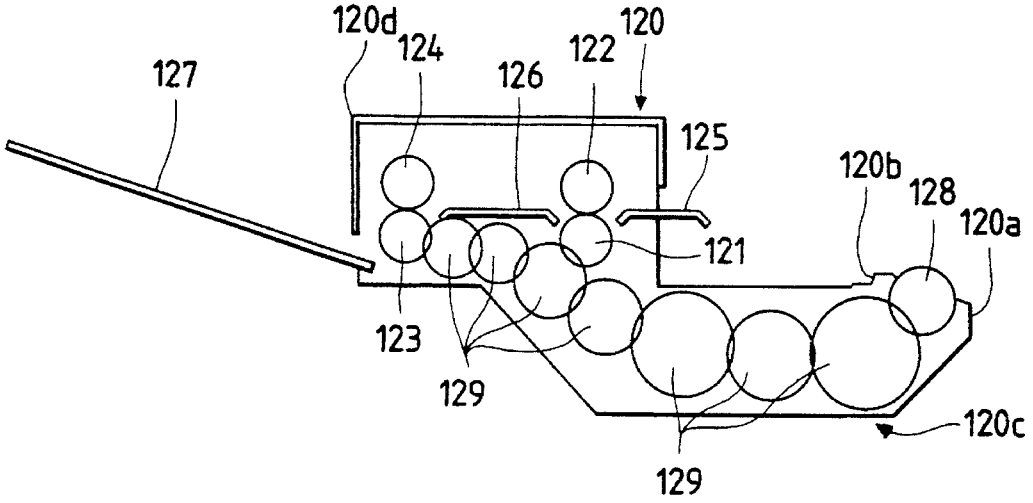
FIG. 8 is a side view showing the fixater shown in FIG. 6.

FIG. 8 is a side view showing the conveying means and driving power transmission mechanism of a fixater 120 according to an embodiment of the present invention. FIG. 6 is a vertically sectional view showing a state where the fixater 120 shown in FIG. 8 is mounted in the image recording apparatus 103 shown in FIG. 5.

The aforesaid fixater 120 is detachably mounted with respect to the aforesaid image recording apparatus 103 in place of the aforesaid cassette 101 in the mounting section of the cassette 101 for stacking the recording medium.

In FIG. 6 and FIG. 8, the recording medium which is conveyed from the image recording apparatus 103 to a guide 125 of the fixater 120 is fed onto a heater plate 126 by a feed roller 121 and a pinch roller 122 which presses only both edge portions other than the recording area of the recording medium.

On the reverse side of the heater plate 126, a heater of a self temperature control type 126*a* is installed.

The recording medium which passes on the aforesaid heater plate 126 is exhausted onto the exhaust sheet tray 127 by the exhaust sheet roller 123 and the pinch roller 124 after having been heated.

Here, the peripheral velocity of the exhaust sheet roller 123 is faster than that of the carrier roller 121 by approximately 1%. Therefore, the recording medium is provided with a tension in the conveying direction between the carrier roller 121 and the exhaust sheet roller 123, so that the recording medium is allowed to be in contact with the heater plate 126 more assuredly.

Figure 7:
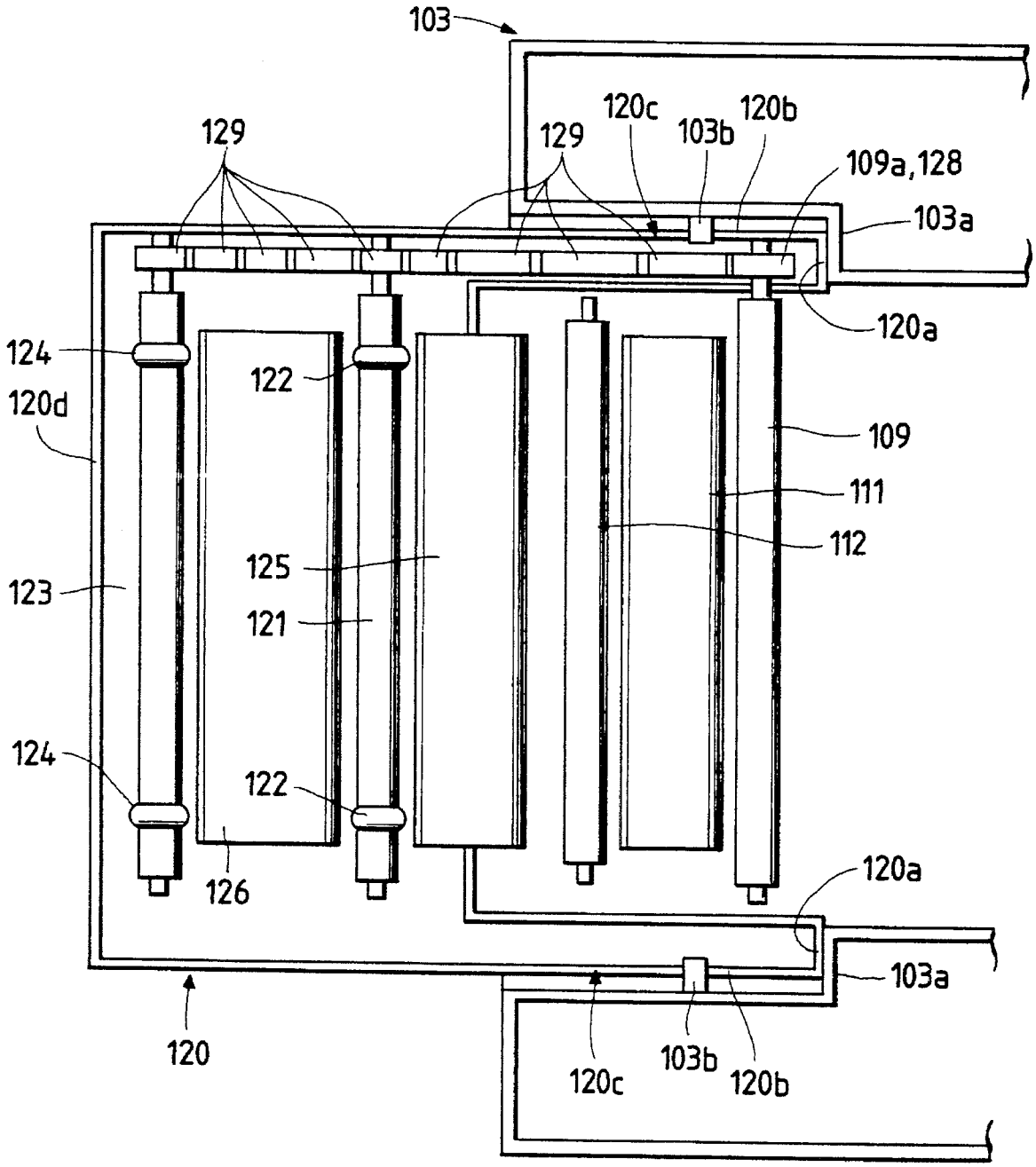
FIG. 7 is a partial plan view showing the fixater and mounting section shown in FIG. 6.

FIG. 7 is a partial plan view showing the conveying mechanism of the image recording apparatus 103 and the conveying means and driving power transmission mechanism of the fixater 120 shown in FIG. 6.

In FIG. 7 and FIG. 8, the carrier roller 121 and exhaust paper roller 123 of the fixater 120 are rotated by the rotation of a driving gear 128 through the transmission gear train 129.

On both sides of the fixater 120 on the image recording apparatus 103 side, coupling means (coupling units) 120*c* to the aforesaid image recording apparatus are provided.

These coupling means 120*c* are the portions which are mostly inserted into the inside of the image recording apparatus 103 when the fixater 120 is mounted therein.

The aforesaid transmission gear train 129 is incorporated inside the one side of the aforesaid coupling means 120*c* as shown in FIG. 7.

In FIG. 6 and FIG. 7, the fixater 120 is detachably mounted by inserting the aforesaid coupling means 120*c* from the mounting section 104 (FIG. 5 and FIG. 9) of the image recording apparatus 103 after the cassette 101 for stacking the recording medium is removed subsequent to the exhaust sheet tray 113 (FIG. 5) of the image recording apparatus 103 having been folded up.

In FIG. 6, FIG. 7 and FIG. 8, the inserted fixater 120 is supported at a regular position in the image recording apparatus 103 in such a way that the butting portions 120*a* of the coupling means 120*c* provided on both side of the fixater hit the abutting portions 103*a* on both sides of the image recording apparatus 103 (FIG. 7 and FIG. 9), and further, the stopper portions 120*b* on both sides of the fixater are fitted into the holding portions 103*b* on both sides of the image recording apparatus.

In this respect, the cassette 101 for stacking the recording medium is positioned by allowing the leading end of the cassette to be touched to the lower portion 105*a* of the guide 105 and mounted by fitting the convexities 101*a* and 101*b* on the cassette side into the concavities or holes 131*a* and 131*b* on the main body side.

Also, in a state where the fixater 120 is fixed at the regular position in the image recording apparatus 103, the driving gear 128 is allowed to engage with the driving gear 109*a*

(FIG. 7 and FIG. 9) fixed to the end of the sub-scanning roller 109 of the image recording apparatus 103 so as to rotate the carrier roller 121 of the fixater 120 and exhaust paper roller 123 in synchronism with the rotation of the sub-scanning roller 109.

In this respect, the peripheral velocity of the carrier roller 121 is defined to be faster than that of the sub-scanning roller 109 by approximately 1%. Therefore, the recording medium is conveyed in a state that it is easily in contact with the heater plate 126.

To remove the fixater 120 from the image recording apparatus 103, the entire body thereof is withdrawn while its leading portion 120*d* is being lifted upwardly. Then, the aforesaid stopper portions 120*b* and holding portions 103*b* are parted, so that the fixater is easily removed therefrom.

In a state after the fixater 120 has been removed, the inner driving gear 109*a* can be observed if viewed from the mounting section 104 into the inside of the image recording apparatus 103. However, the aforesaid driving gear 109*a* is arranged at a position almost in the center of the image recording apparatus 103 as shown in FIG. 6 where no finger can reach from the opening, and there is no problem at all.

Figure 9:
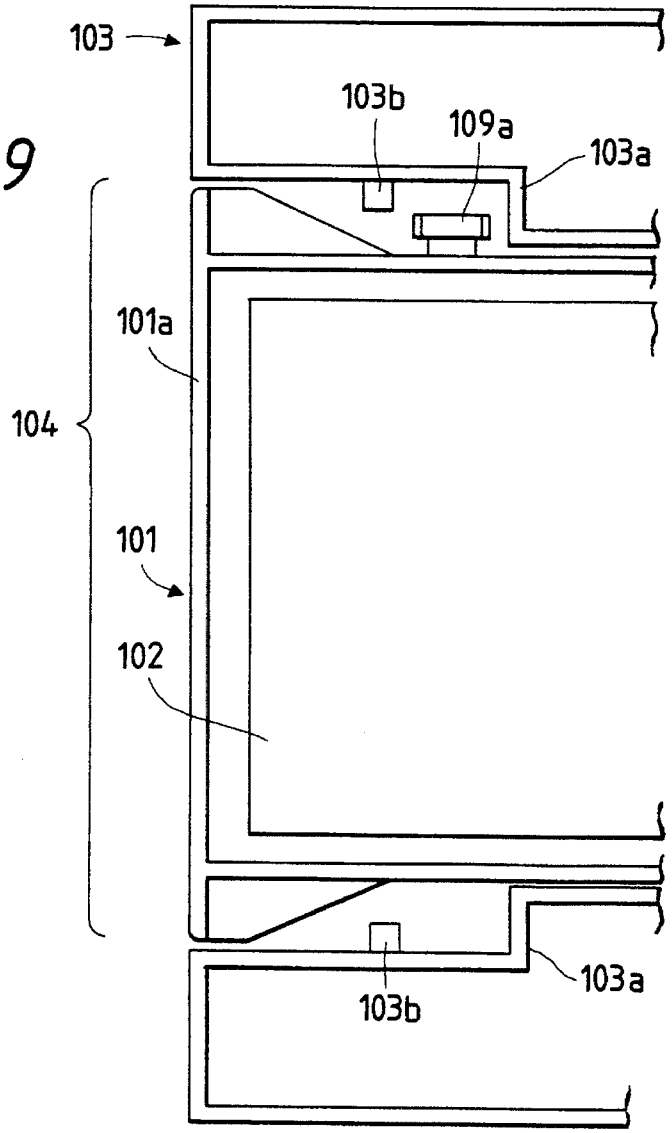
FIG. 9 is a partial plan view showing the mounting section of the cassette for stacking the recording medium shown in FIG. 5.

FIG. 9 is a partial plan view showing a state of the mounting section 104 when the cassette 101 for stacking the recording medium is mounted in the image recording apparatus 103.

In FIG. 9, the driving gear 109*a*, abutting portions 103*a*, and the holding portions 103*b* on the image recording apparatus side cannot be observed when the aforesaid cassette 101 for stacking the recording medium has been mounted in the image recording apparatus 103 because the outer end 10*a* of the cassette 101 is widened to match the entrance of the mounting section 104 of the image recording apparatus 103.

With a structure such as above, it becomes possible to exhaust even the OHP sheet and other recording media which are inferior in fixing properties onto the exhaust sheet tray 127 after a complete treatment of fixation if such recording medium is inserted from the manual insertion tray 114 in a state that the fixater 120 is mounted in the image recording apparatus 103.

Also, in the present example embodying the present invention, the driving power for the conveying means 121 and 123 of the fixater 120 is obtained directly from the driving mechanism of the image recording apparatus 103 through the driving gear 109*a*. Accordingly, there is no need of installing any motor, power source, driving control circuit, and others in the fixater 120 itself. Hence, it is possible to construct the fixater 120 inexpensively.

Furthermore, as the fixater 120 is mounted at a position far from the recording head 110 of the image recording apparatus 103, there is no possibility that the water vapor reaches the recording head 110 even if generated by the evaporation of ink recorded on the OHP or the like due to the heating of the heater plate 126 thereby to moisturize the vicinity of the discharging port. Thus, the normal ink discharging condition is maintained to make it possible to keep the recording quality high.

In this respect, the fixing means of the fixater 120 is structured by the heater plate 126 in this example embodying the present invention, but it may be possible to use a hot air infrared radiation or some other heating means or drying means.

Also, in this example embodying the present invention, the driving power for the conveying means 121 and 123 for the fixater 120 is obtained from the image recording apparatus 103 through the driving gear 109*a*, but it may be possible to obtain it using a belt or some other type of driving mechanism or provide the fixater itself with a motor, power source, control circuit and others.

Also, in this example embodying the present invention, the description has been made of the case where the image recording apparatus 103 is of an ink jet recording type, but the present invention is applicable to the image recording apparatus using some other kind of recording head and its fixater, and furthermore, the present invention is applicable to a secondary fixing means in an electronic photographic system.

Also, in this example embodying the present invention, although the cassette 101 for stacking the recording medium is of a one stage type, the present invention is applicable to an image recording apparatus having a paper supply cassette mechanism of two or more stages.

Figure 10:
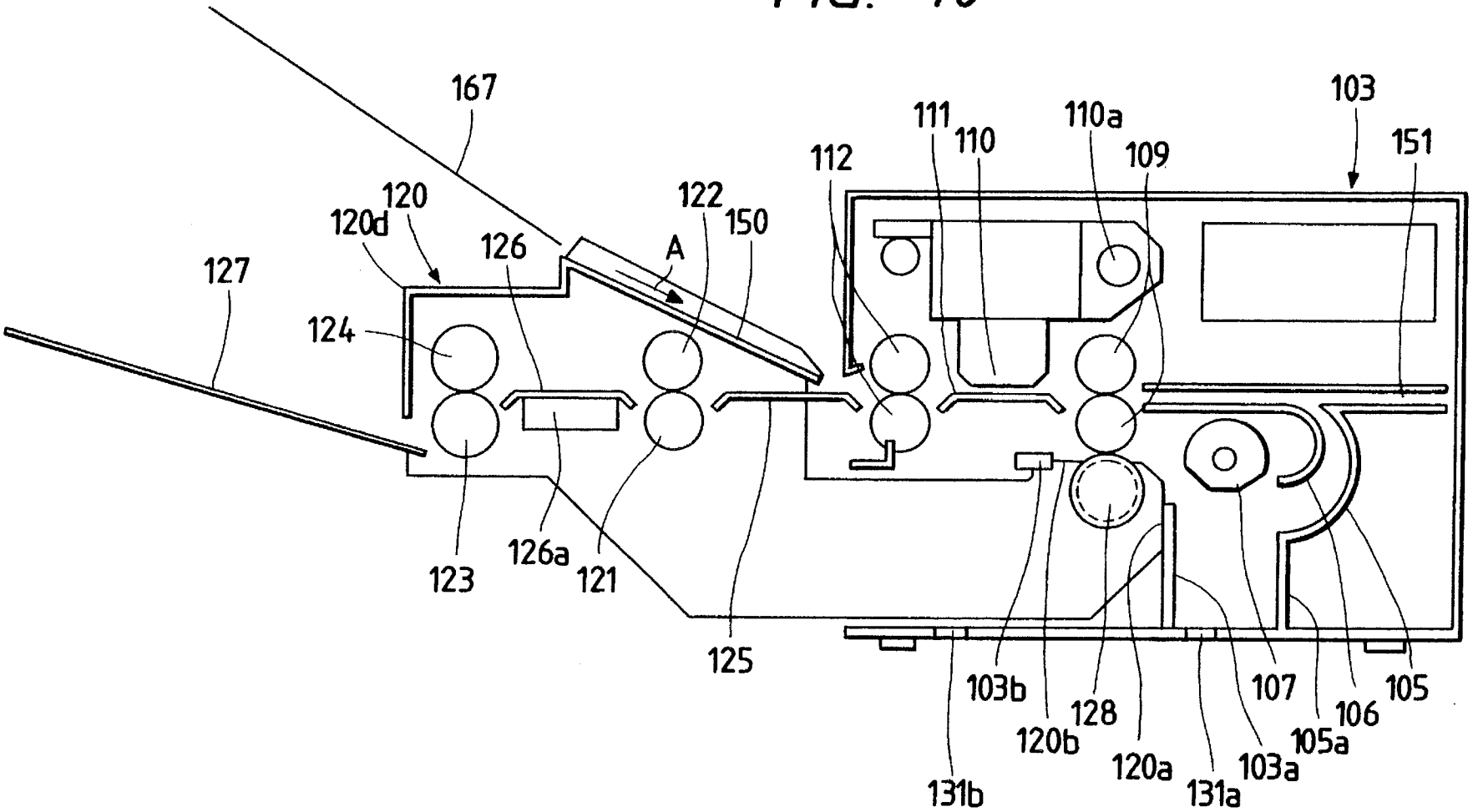
FIG. 10 is a vertically sectional view schematically showing a second example embodying the image recording apparatus in which a fixater according to the embodiment of the present invention is mounted.

FIG. 10 is a vertically sectional view showing a second embodiment of a fixater and image recording apparatus according to an embodiment of the present invention.

As shown in FIG. 10, this example embodying the present invention is of such a structure that a manual insertion sheet feeding guide 150 used for a manual sheet supply is provided for the fixater 120 and that the manual sheet supply is performed by inserting the recording medium 167 along the aforesaid manual sheet insertion feeding guide 150 in the direction indicated by arrow A.

In FIG. 10, when the leading end of the recording medium 167 manually inserted along the manual sheet insertion feeding guide 150 hits the nip of the pair of exhaust paper rollers 112 of the image recording apparatus 103, the insertion of the recording medium 167 is detected by a detecting means (not shown) to cause the pair of exhaust paper rollers 112 and pair of sub-scanning roller 109 to be driven to rotate reversely, thus allowing the manually inserted recording medium 167 to be pulled into the guide 151 of the image recording apparatus 103.

When the trailing end of the recording medium 167 has passed through the aforesaid detecting means, the pair of sub-scanning rollers 109 and pair of exhaust paper rollers 112 are caused to be driven immediately to rotate reversely in the regular rotational direction. Then, thereafter, the structure is arranged to perform the recording in the same procedure as in the case of the example shown in FIG. 6 embodying the present invention.

This example embodying the present invention differs in the aspects set forth above from the example shown in FIG. 6 through FIG. 10 embodying the present invention, but in other aspects, the structure is essentially the same. Therefore, each of the corresponding parts is provided with a same reference mark, and its detailed description will be omitted.

Consequently, this second example embodying the present invention also makes it possible to achieve the same functional effects as in the case of the aforesaid first example embodying the present invention.

Figure 11:
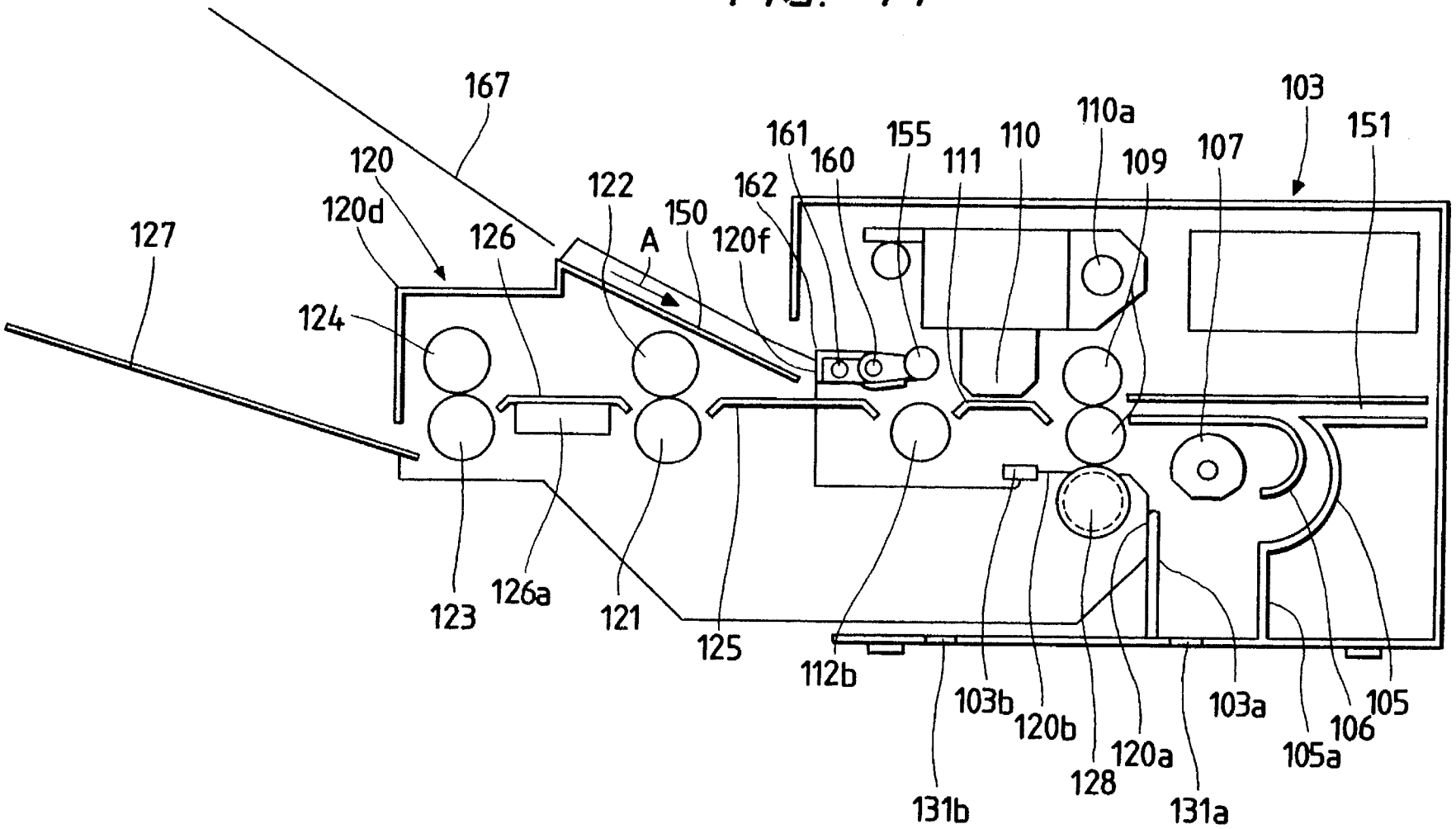
FIG. 11 is a vertically sectional view schematically showing a third example embodying the image recording apparatus in which a fixater according to the embodiment of the present invention is mounted.

FIG. 11 is a vertically sectional view showing a third embodiment of a fixater and image recording apparatus according to an embodiment of the present invention.

This example embodying the present invention is of such a structure that when the fixater 120 is mounted in the image recording apparatus 103, the butting portion 120*f* of the fixater 120 hits the pressure releasing plate 162 of the aforesaid image recording apparatus 103 to cause the upper exhaust paper roller 155 of the aforesaid image recording apparatus 103 to be retracted to a position where the roller is not in contact with the recording surface of the recording medium.

FIG. 11 illustrates a state where the aforesaid upper exhaust sheet roller 155 has been retracted.

Figure 12A:
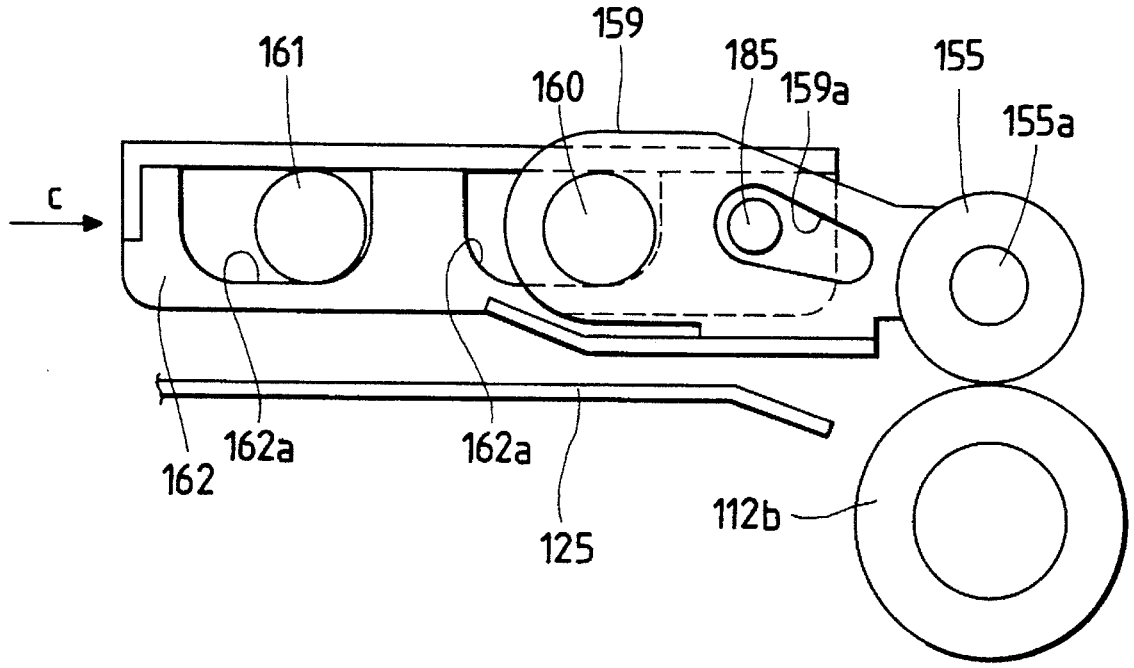
FIGS. 12A and 12B are side views showing the structure of the exhaust roller retracting mechanism shown in FIG. 11.
Figure 12B:
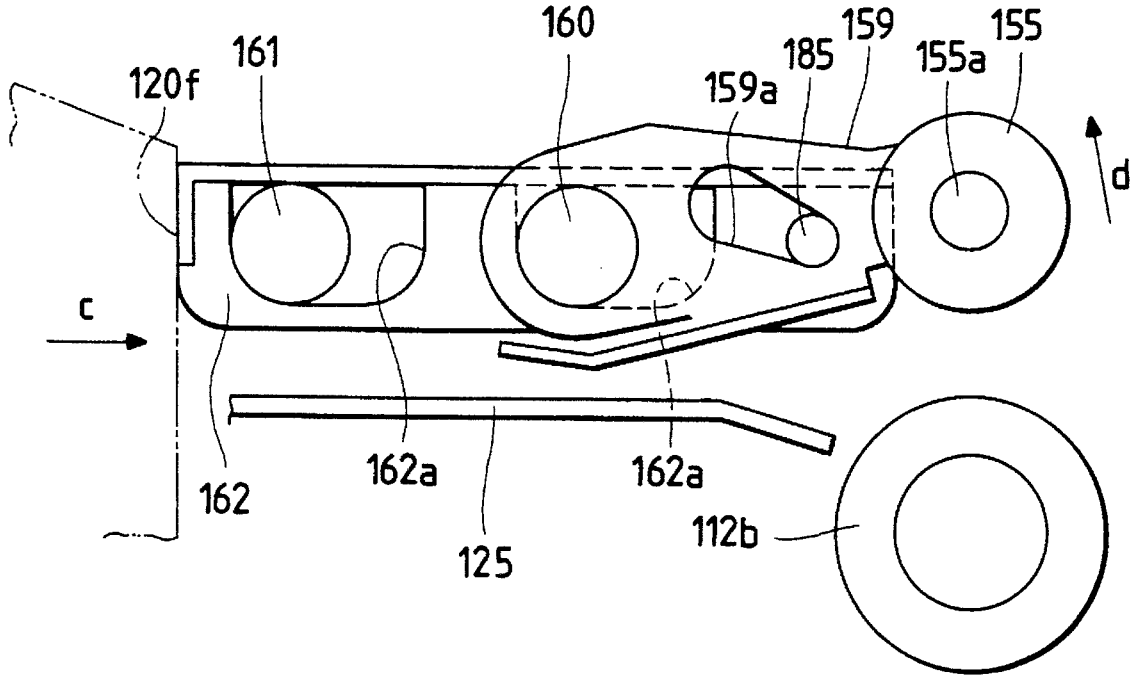

FIG. 12 is a side view showing the details of the retraction mechanism for retracting the aforesaid upper exhaust sheet roller 155 shown in FIG. 11, and FIG. 12A illustrates the state before the retraction (before the fixater is mounted) and FIG. 12B illustrates the state where the fixater has been mounted to enable the retraction.

In FIG. 11 and FIG. 12, the upper exhaust sheet roller 155 is rotatively supported on the exhaust sheet pressure plate 159 by a roller shaft 155*a*, and the aforesaid exhaust sheet pressure plate 159 is rotatively supported by an exhaust paper pressure shaft 160.

The aforesaid exhaust sheet pressure plate 159 is biased by a pressure spring (not shown) in the direction to enable the upper exhaust sheet roller 155 to be in contact with the lower exhaust sheet roller 112*b*.

The aforesaid pressure releasing plate 162 is mounted by elongated holes 162*a* and 162*a* to be movable in the horizontal direction with respect to the exhaust sheet pressure shaft 160 and exhaust sheet shaft 161.

On the pressure releasing plate 162, a release pin 185 is provided. The aforesaid release pin 185 engages with an elongated hole 159*a* provided in a diagonal direction in the exhaust sheet pressure plate 159.

In this respect, an arrow c in FIG. 12 indicates the direction in which the fixater 120 is inserted.

With the above-mentioned structure, when the fixater 120 is inserted into the image recording apparatus 103 in the direction indicated by arrow c for mounting, the aforesaid butting portion 120*f* depresses the pressure releasing plate 162 in the right-hand direction in FIG. 12 to move the aforesaid pressure releasing plate 162 in that direction.

When the pressure releasing plate 162 is moved as shown in FIG. 12B, the release pin 185 of the aforesaid pressure releasing plate 162 causes the exhaust sheet pressure plate 159 to be lifted through the elongated hole 159*a* in the direction indicated by arrow d in FIG. 12B.

Thus, the exhaust sheet pressure plate 159 is rotated upwardly around the exhaust sheet pressure shaft 160 as its center thereby to allow the upper exhaust sheet roller 155 to be retracted to a position where the roller is not in contact with the recording surface of the recording medium.

This example embodying the present invention differs in the aspects set forth above from the example shown in FIG. 10 embodying the present invention, but in other aspects, the structure is essentially the same. Therefore, each of the corresponding parts is provided with a same reference mark, and its detailed description will be omitted.

According to the example embodying the present invention as described above in conjunction with FIG. 11 and FIG. 12, not only it is possible to obtain the same effects as in each of the aforesaid examples embodying the present invention but the effects given below are also obtainable.

In other words, the structure is arranged to allow the exhaust sheet roller (upper exhaust sheet roller) 155 of the image recording apparatus 103 to be retracted from the recording surface of the recording medium when the fixater 120 is mounted. Hence, even in the case where a recording is performed on a recording medium which is inferior in the ink fixing property or a recording is performed with an ink which is inferior in its absorbency, it becomes possible to carry the recording medium 167 onto the fixater 120 without any image smearing caused by the upper exhaust paper roller 155.

In this respect, the aforesaid upper exhaust sheet roller 155 may be retracted as a whole or with a divisional structure, it may be possible to cause only the intermediate portion thereof to be retracted while keeping under pressure the edge portions on both sides other than the recording area of the recording medium.

According to each of the examples embodying the present invention set forth above, the effects given below are obtainable.

i) As a fixing means (heater and others) used for an OHP sheet and other recording media having inferior fixing property which are not in frequent use is structured as a fixater 120 detachably mountable in the image recording apparatus 102, it becomes possible to reduce the manufacturing cost of the main body of the image recording apparatus.

ii) The structure is arranged so that the cassette 101 for stacking the recording medium for the image recording apparatus 103 can be removed, and that the fixater 120 can be detachably mounted by utilizing the mounting section 104 for the cassette. Therefore, there is no need of providing any mounting section dedicated for the fixater, thus making it possible to keep the outer appearance of the image recording apparatus 103 in a beautiful state.

iii) The structure is arranged to obtain the driving power of the recording medium conveying means 121 and 123 for the fixater 120 form the image recording apparatus 103. As a result, there is no need of providing any driving source for the fixater 120 itself, so that the cost of the aforesaid fixater is lowered.

iv) The transmission of the driving power from the image recording apparatus 103 to the fixater 120 is structured to allow it to be performed within the mounting section 104 of the cassette 101 for stacking the recording medium. No power transmission mechanism such as gears is exposed to the outside of the main body of the apparatus. Also, there is no need of providing any opening and others required for receiving the driving power separately thereby to keep the outer appearance of the image recording apparatus 103 in a beautiful state.

v) The transmission of the driving power from the image recording apparatus 103 to the fixater 120 is structured to allow it to be performed within the mounting section 104 of the cassette 101 for stacking the recording medium, thus making it possible to arrange the gears and others for driving the fixater 120 at a position within the aforesaid mounting section 104 where no fingers of a hand inserted from the opening can reach, and the driving gears and others are not exposed to the outside even if the cassette 101 for stacking the recording medium remains unmounted. Accordingly, there is obtained an image recording apparatus capable of securing the safety without any shutter or the like to be especially provided for the purpose.

vi) As the fixater 120 is mounted at a position away from the recording head 110 of the image recording apparatus 103, there is no possibility that the vicinity of the recording head 110 is moisturized by the water vapor generated by the evaporation of ink recorded on an OHP sheet or others by the heating of the heater plate 126 and others. Thus, the normal ink discharging condition can be maintained to make it possible to keep the recording quality high.

In this respect, the descriptions have been made of the case where the present invention is mainly applied to an image recording apparatus of an ink jet type in each of the examples embodying the present invention. The present invention, however, is equally applicable to the other image recording apparatuses using different kinds of recording heads such as a wire dot type, thermal or other type, and the same effects can also be obtained.

Also, in the above-mentioned examples embodying the present invention, the description has been made of the image recording apparatus of a serial type where the recording is performed while the recording head 110 is being moved in the width direction of the recording medium. The present invention, however, is equally applicable to an image recording apparatus of a line type where a line recording head is used to cover the entire or a part of the recording area in the paper width direction so that the same effects can also be obtained.

Furthermore, in the above-mentioned examples embodying the present invention, the description has been made of the case where the image recording apparatus performs the recording with only one recording head 110. The present invention, however, is equally applicable, irrespective of the number of the recording heads, to a color image recording apparatus having a plurality of recording heads for recording in different colors, or an image recording apparatus for a tonal recording using a plurality of recording heads for performing the recording in the same color but different densities or the like, and the same effects can also be obtained.

Also, as the recording head 110 in the above-mentioned examples embodying the present invention, it is possible to use a recording head of a cartridge type with the recording unit and ink reservoir being integrally constructed or with the recording unit (ink discharging unit and others) and the ink reservoir (ink tank and others) being separately arranged such as a recording head constructed by coupling a coupler and tube, or a recording head structured by only a recording unit without any ink reservoir or various other types of recording heads.

As clear from the above descriptions, with the fixater according to the above-mentioned examples embodying the present invention, it is possible to provide a fixater capable of expediting the fixation assuredly without making the recording apparatus large and increasing the manufacturing cost even in the case of a recording medium which requires a fixation as well as eliminating the degradation of the recording quality due to the recording head moisturizing and the like, and a recording apparatus using the aforesaid fixater.

Figure 13:
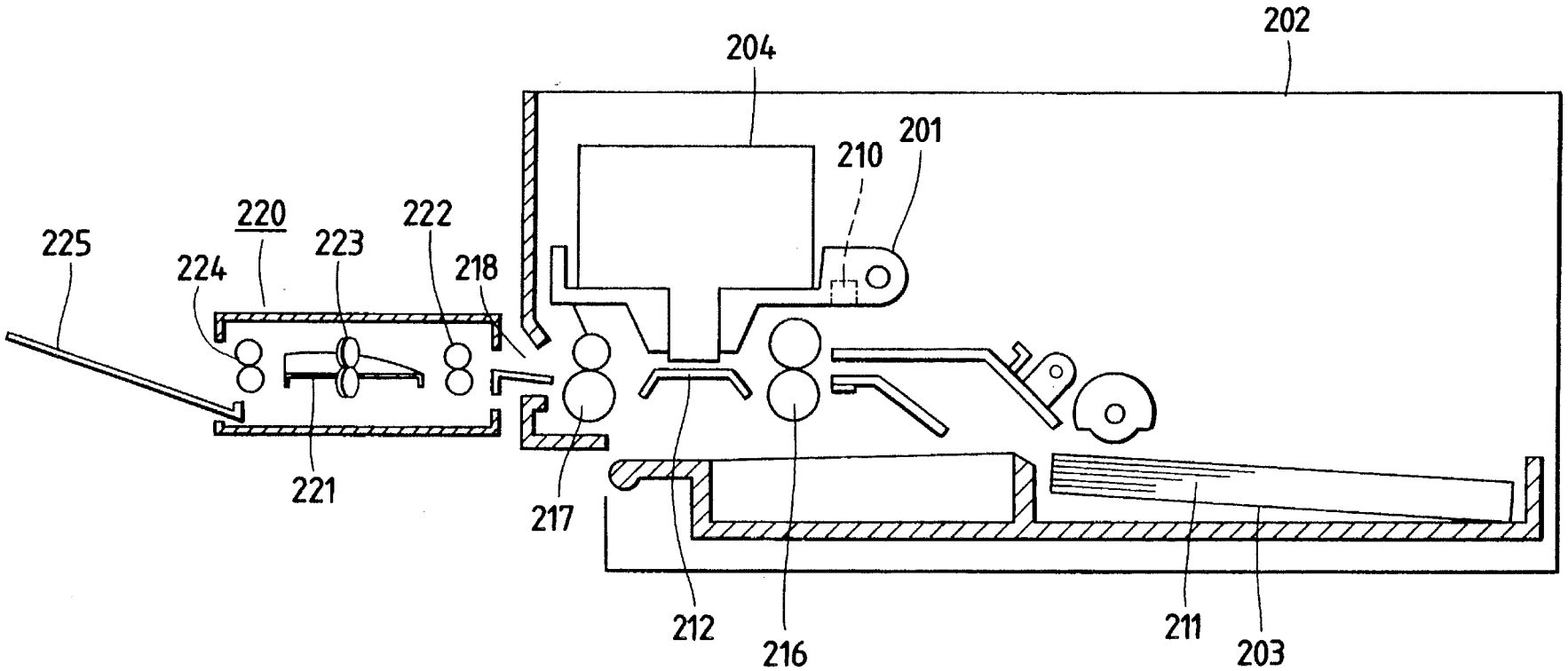
FIG. 13 is a cross-sectional view showing a fourth example embodying the present invention.

FIG. 13 is a view showing a fourth example embodying the present invention, and the fixater 220 is provided in its inside with a heating carrier pass or passage 221 for a recording paper 211 which is a recording medium and a plurality of carrier rollers 222, 223, and 224. Each of the carrier rollers 222, 223, and 224 is arranged to be in contact with the blank portions of the recording sheet 211 so as not to touch ink on the recording sheet 211. Further, there is provided an exhaust sheet tray 225 on the downstream side of these rollers on the left-hand side in FIG. 13. Also, the fixater 220 is detachably mounted in a mounting section (not shown) provided on the exhaust sheet opening 218 of the main body of an image formation apparatus 202, and in the aforesaid mounting section, a first sensor (not shown) for detecting whether or not the fixater 220 is mounted, and a electric power supply unit (not shown) is provided for supplying an electric power from the main body of the image formation apparatus 202 to the fixater 220.

In the main body of the image formation apparatus 202, a cassette 203 for stacking plural sheets of recording paper 211 is arranged at the bottom thereof, and on the downstream side of the cassette, the left-hand side of FIG. 13, there are arranged a pair of paper feed rollers 216, a recording head 204 and a carriage 201 with a reflective sensor 210 installed thereon, a platen plate 212 with its black surface for supporting the recording sheet 211, which faces the aforesaid recording head 204, and a pair of tension rollers 217, respectively. The paper feed rollers 216 and tension rollers 217 are formed cylindrical having the length substantially the same as the maximum width of the recording sheet 211, respectively, and at the same time, are driven by a driving means (not shown) in such a way that the peripheral velocity of the tension rollers are slightly faster than that of the paper feed rollers 216. Then, the recording sheet 211 is conveyed between the recording head 204 and the platen plate 212 by the paper feed rollers 216 for printing, and exhausted from the exhaust sheet opening 218 through the tension rollers 217.

Subsequently, in reference to FIG. 14, the reflection type sensor 210 shown in FIG. 13 will be described.

Figure 14:
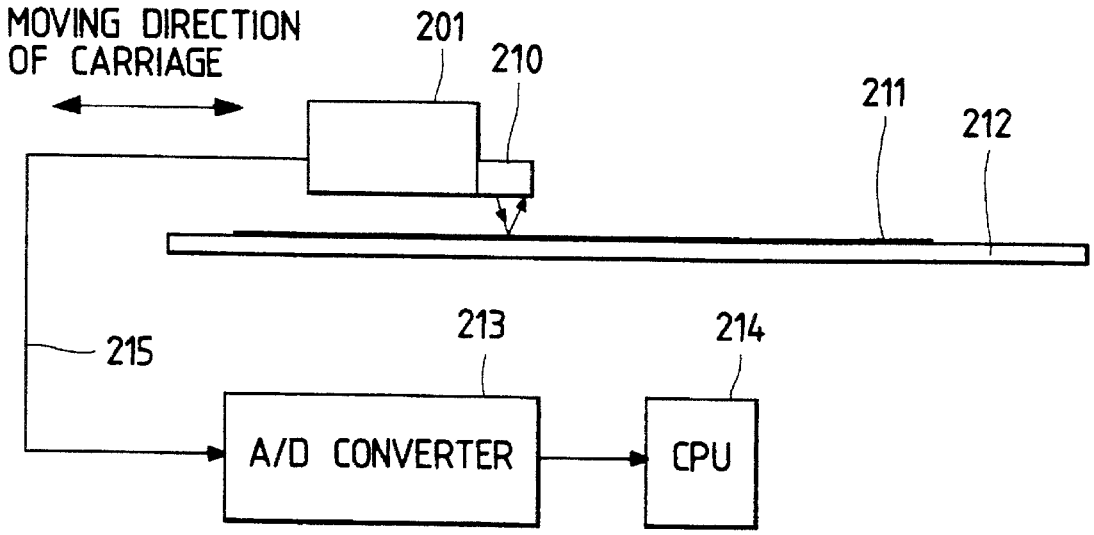
FIG. 14 is a view illustrating the operation of a reflection type sensor.

In FIG. 14, the reflection type sensor 210 mounted on the carriage 201 as a second sensor emits light towards the platen plate 212 when the sensor is moved together with the carriage 201 on the aforesaid platen plate 212 to detect the luminous intensity of the reflected light of the platen 212 or the recording medium 211 on the platen 212. As described above, the surface of the platen plate 212 is black to absorb most of the light emitted from the reflection type sensor 210, but as the usual sheet is white, most of the light emitted from the reflection type sensor 210 is reflected on the surface of the sheet and received by the light receiving portion (not shown) of the reflection type sensor 210. On the other hand, in the case of an OHP sheet, the condition is intermediate and a part of the light emitted is absorbed and the remaining portion is reflected. Then, the reflection type sensor output 215 which is the output of the reflection type sensor 210 in these cases is converted into digital signals by an A/D converter 213 and inputted into a CPU 214. The values themselves change by the various conditions, but, for example, in a case of the white sheet, the input value is defined to 5 V, in a case of the OHP sheet, 3 V, and in a case of no sheet or OHP sheet, 1 V for the required discrimination.

Next, in reference to FIG. 15A and FIG. 15B, the description will be made of the paper feed rollers 216 and tension rollers 217.

Figure 15A:
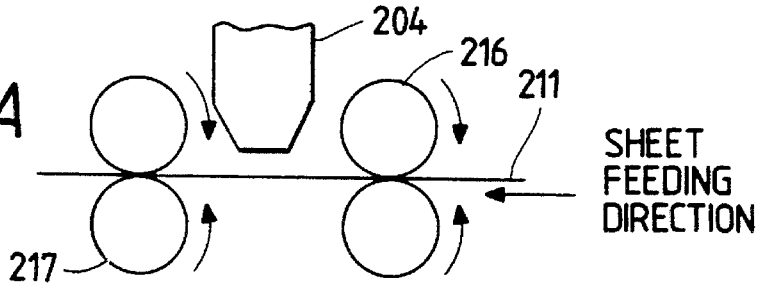
FIGS. 15A and 15B illustrate the operations of paper feed rollers and tension rollers and FIG. 15A illustrates the case of an ordinary paper while FIG. 15B, the case of an OHP sheet.

In the case of a recording sheet 211 being an ordinary paper, the recording is performed by the recording head 204 while the recording sheet 211 is in a state as shown in FIG. 15A that he paper feed rollers 216 and tension rollers 217 are driven to give tension to the recording sheet. However, in the case of a recording sheet 211 being an OHP sheet, the tension rollers 217 may be stained by ink if the OHP sheet is drawn by the tension rollers 217 immediately after printing because the ink has not been absorbed in the recording sheet 211. Therefore, as shown in FIG. 15B, the tension roller 217 which is usually in contact with the inked surface of the recording sheet 211 is lifted (released) from the recording sheet 211 by a conveying mechanism (not shown) and the sheet is carried by the feed rollers 216 by making use of the heavy weight of the OHP sheet.

Now, the operation of this example embodying the present invention will be described.

Figure 15B:
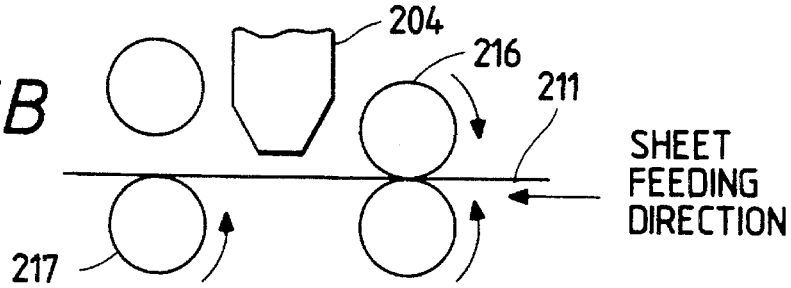
Figure 16:
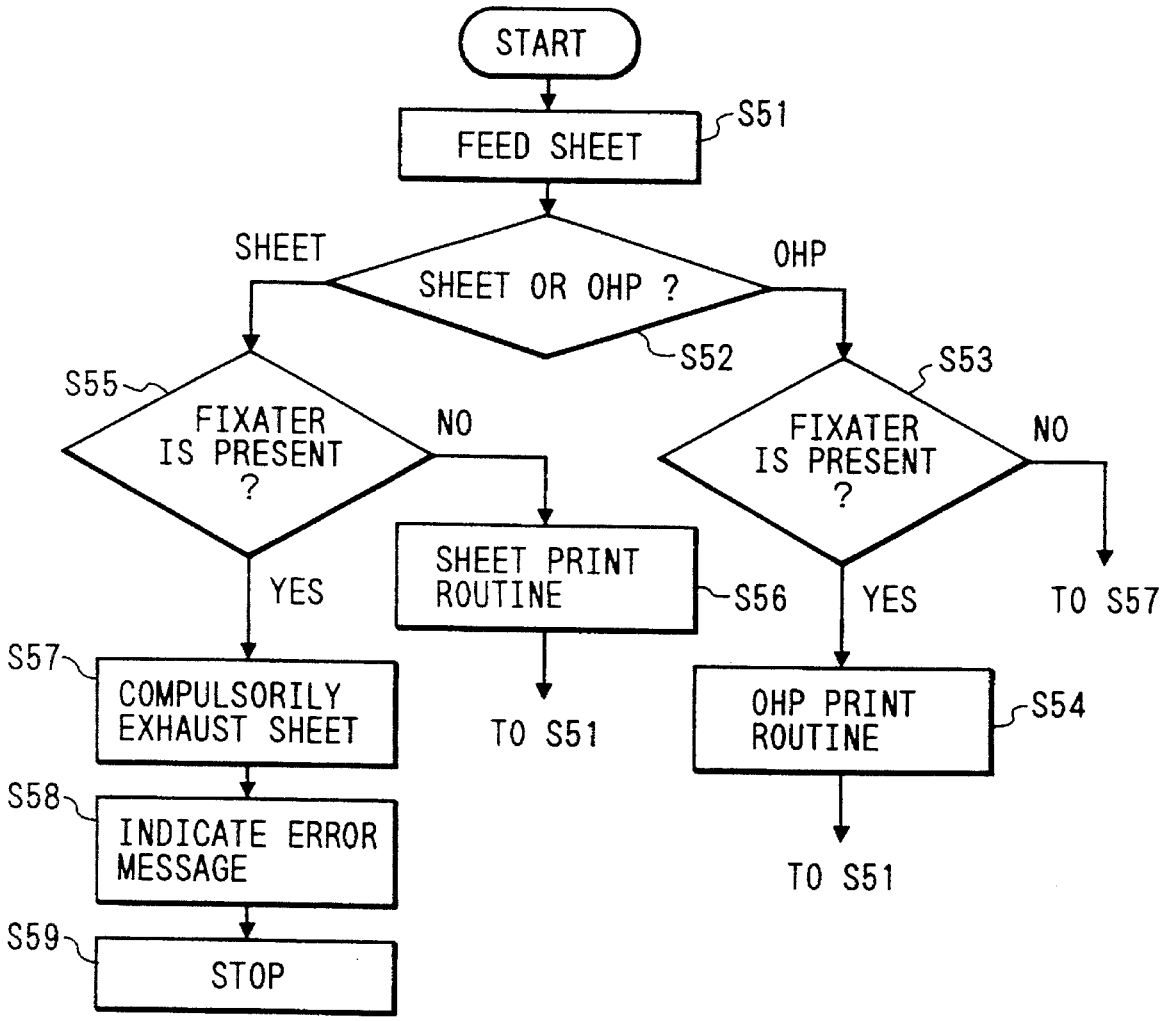
FIG. 16 is a flowchart showing the operation of the fourth example embodying the present invention.

In FIG. 16, when the image formation apparatus according to this example embodying the present invention receives an instruction from an operator to start the printing, the recording sheet 211 is fed (step S51), and by the reflection type sensor output 215 shown in FIG. 14, whether the recording sheet 211 is an ordinary sheet or an OHP sheet is discriminated, i.e., the kinds of the recording media 211 are discriminated (step S52). In the case of an OHP sheet, the presence of the fixater 220 (refer to FIG. 13) is examined (step S53), and if the fixater is mounted, the tension roller 217 is released as shown in FIG. 15B. Then, the printing is performed by the OHP print routine (step S54). Subsequently, the process returns to the step S51 and the above-mentioned operation is repeated. If the fixater 220 is not mounted, a compulsory sheet exhausting (step S57) and an error message display (step S58) are executed. Then, the process is suspended (step S59).

In the meantime, if the recording sheet 211 is found to be paper at the step S52, the presence of the fixater 220 shown in FIG. 13 is judged (step S56), and if the fixater is not mounted, the tension rollers 217 are allowed to be in contact with the both sides of the recording sheet 211 as shown in FIG. 15A. Then, the printing is performed by the sheet print routine (step S56). Subsequently, the process returns to the step S51 to repeat the above-mentioned operation. If the fixater 220 is mounted, a compulsory sheet exhausting (step S57) and an error message display (step S58) are executed. Then, the process is suspended (step S59).

In the fourth example embodying the present invention as shown in FIG. 13 through FIG. 16, a platen plate is provided, but the present invention is not limited to the use thereof, and a platen roller may be provided instead.

Figure 17:
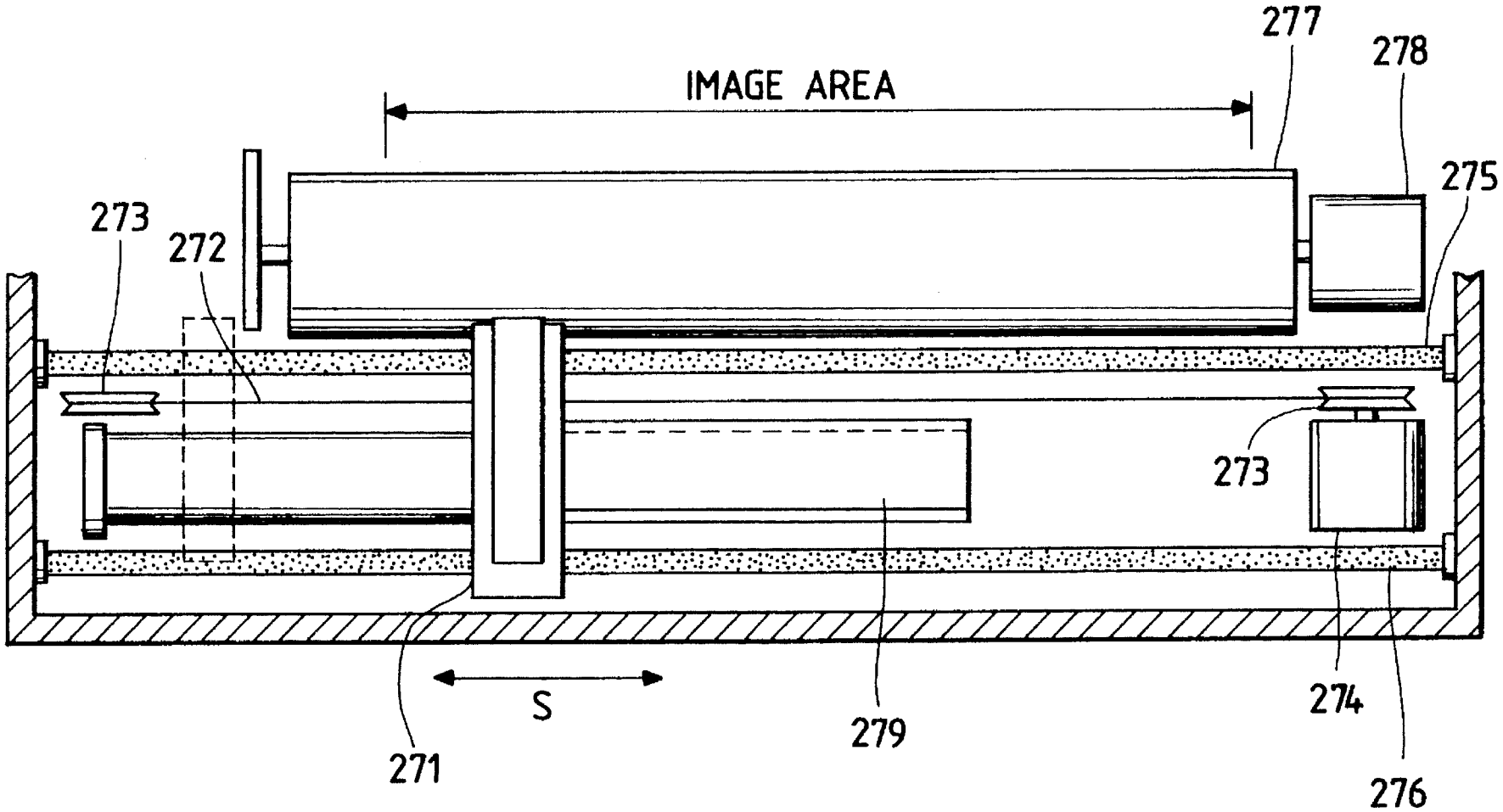
FIG. 17 is a plan view showing the principal part of a fifth example embodying the present invention.

FIG. 17 is a view showing an example of an image formation apparatus provided with a platen roller as a fifth example embodying the present invention, in which a reference numeral 271 designates a carriage. The aforesaid carriage 271 is fixed to a wire 272 and is driven to reciprocate for scanning in the directions indicated by arrow S. The aforesaid wire 272 is tensioned around two pulleys 273 provided respectively at both end of the traveling range of the carriage 271. To one of the pulleys 273, a carriage motor 274 is connected as a driving source for driving the carriage 271 to scan in the directions indicated by arrow S. Further, two carriage guide rails 275 and 276 are provided extendedly in parallel to the directions indicated by arrow S for guiding the carriage 271.

A reference numeral 277 designates a cylindrical platen roller with black surface, and the aforesaid platen roller 277 supports a recording medium to regulate the recording surface, and is driven at the same time by a platen driving motor 278 which is caused to rotate when the recording medium is conveyed. Also, a reference numeral 279 designates a cable for transmitting control signals, the one end of which is connected to the carriage 271 and the other end, to a control means (not shown), and image data, control signals and others are transmitted between the control means and the carriage. This cable 279 is flexible so as to follow the displacement of the carriage 271.

Figure 18:
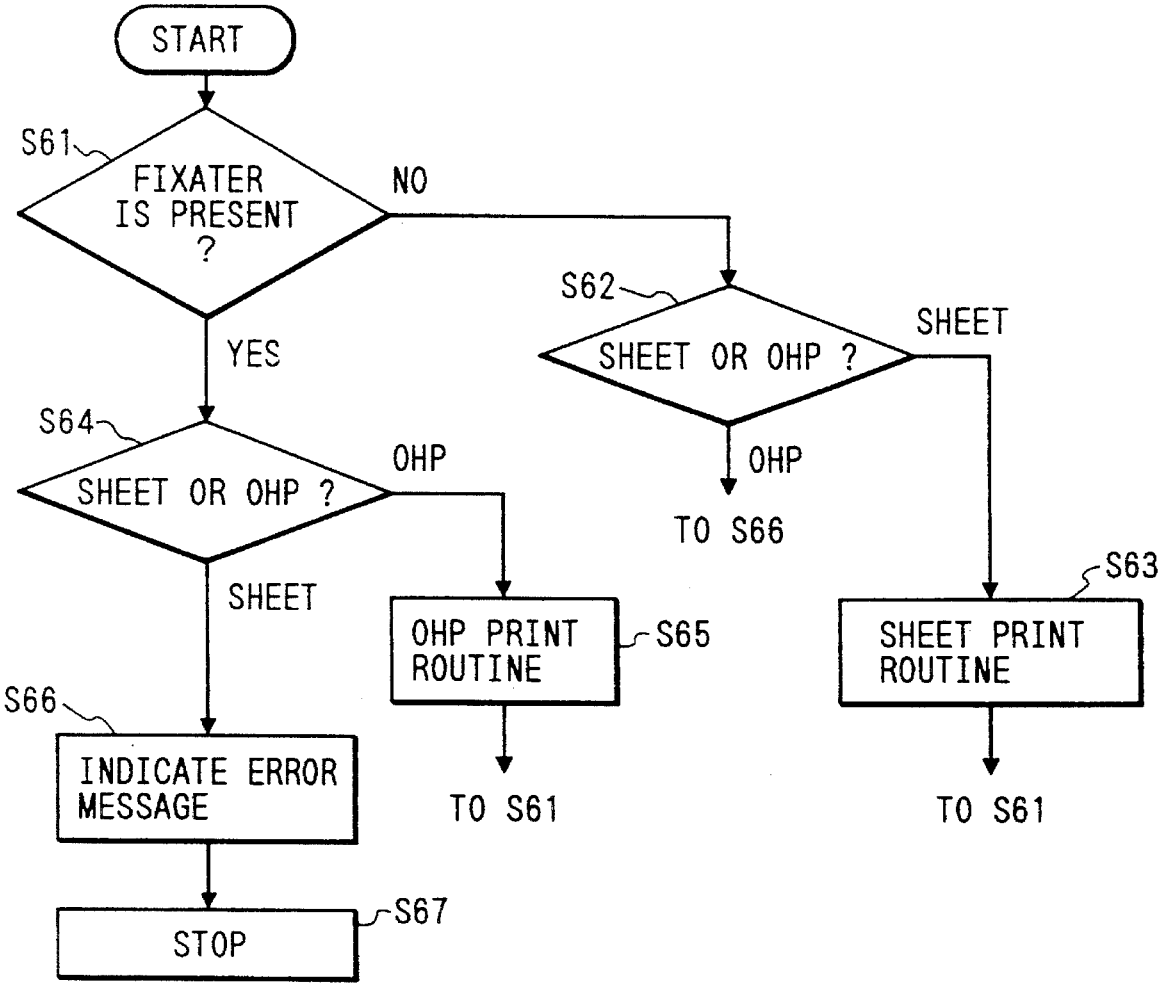
FIG. 18 is a flowchart showing the operation of a sixth example embodying the present invention.

FIG. 18 shows the operation of the sixth example embodying the present invention. At first, the presence of the fixater is judged (step S61), and if the fixater is not found to be mounted, the kinds of the recording medium, i.e., whether the recording medium is an ordinary sheet or an OHP sheet, is discriminated (step S62). If the recording sheet is an OHP sheet, an error message is displayed (step S66) and the process comes to a stop (step S67). If the recording sheet is an ordinary sheet, the printing is executed by the sheet print routine (step S63), and subsequently, the process returns to the step S61 to repeat the above-mentioned operation.

In the case where he fixater is mounted, whether the recording medium is an ordinary sheet or an OHP sheet is discriminated (step S64), and if the recording medium is an OHP sheet, the printing is executed by the OHP print routine (step S65), and subsequently, the process returns to the step S61 to repeat the above-mentioned operation. If the recording medium is an ordinary sheet, an error message is displayed (step S66), and the process comes to a stop (step S67).

In this example embodying the present invention, the discrimination of the recording medium is made before the sheet feeding. Therefore, unlike the step S75 shown in FIG. 16, there is no need of any compulsory sheet exhausting, thus making the sheet handling convenient.

Figure 19:
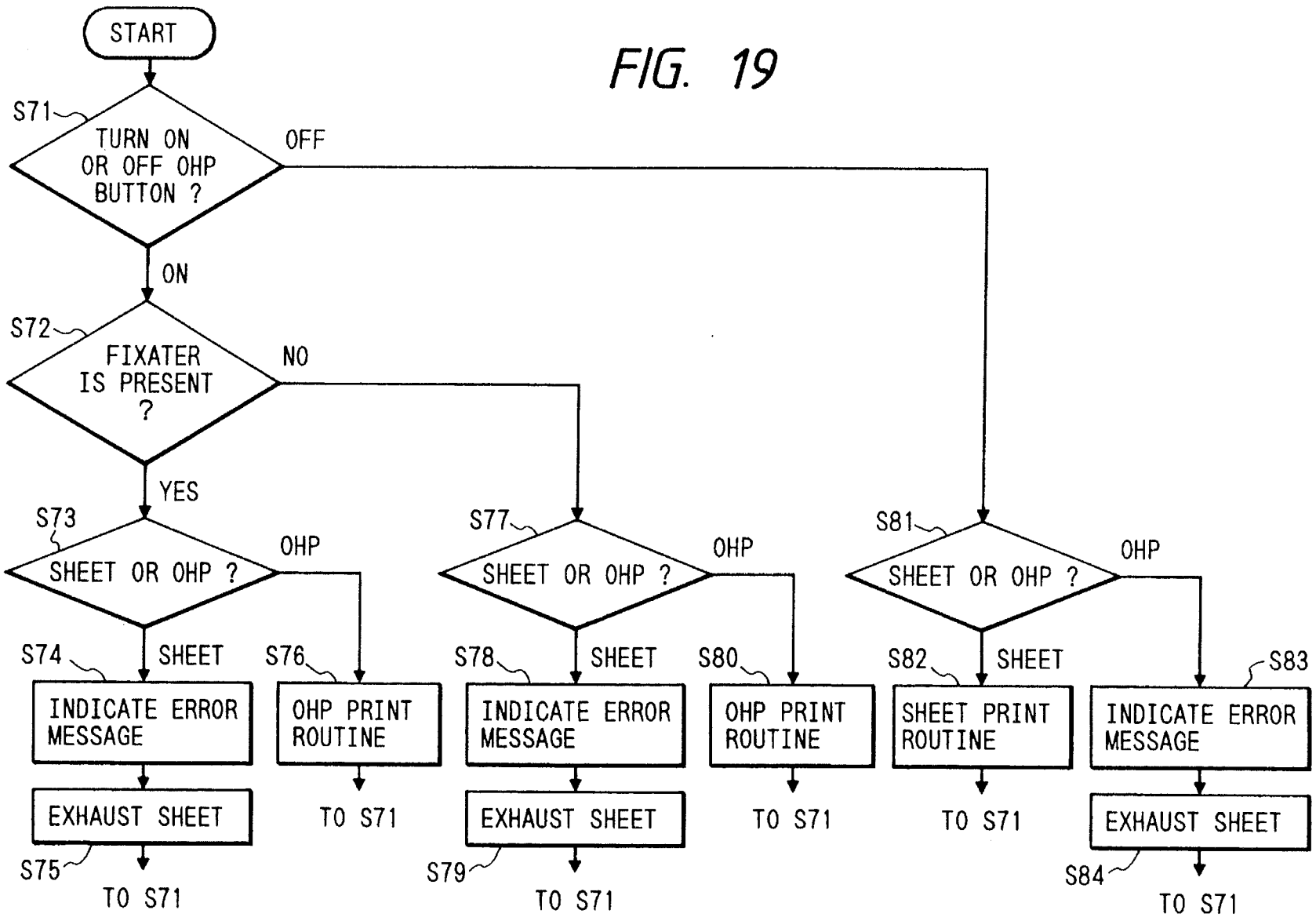
FIG. 19 is a flowchart showing the operation of a seventh example embodying the present invention.

FIG. 19 is a flowchart showing the operation of a seventh example embodying the present invention.

In this example embodying the present invention, an OHP sheet selection button is provided in addition to the detection sensor for detecting whether or not the fixater 220 is mounted, and the sensor for discriminating the kind of recording sheet 211. This OHP sheet selection button is arranged not only to be depressed by an operator, but also to be automatically depressed when the fixater 220 is mounted.

When the OHP selection button is depressed (step S71), the presence of the fixater 220 is detected (step S72). If the fixater 220 is mounted, the kind of the recording sheet 211 is discriminated (step S73). Then, if the recording sheet is an ordinary sheet, an error message is displayed (step S74) and the compulsory sheet exhausting is executed (step S75). On the other hand, if the recording sheet is an OHP sheet, the printing is executed by the OHP print routine (step S76).

At the step S72, if no presence of the fixater 220 is defined by the judgment, the kind of the recording medium 211 is discriminated at the step S77, and if the recording sheet is found to be an ordinary sheet, an error message is displayed (step S78) and the compulsory sheet exhausting is executed (step S79). On the other hand, in the case of an OHP sheet, the printing is executed by the OHP print routine (step S80).

Also, if the OHP selection button is not found to be depressed by the judgment made at the step S71 (as the fixater 220 is mounted, the OHP selection button is turned on automatically, hence, in this case, the fixater 220 is not mounted), the kind of the recording medium 211 is discriminated at the step S81.

Then, in the case of an ordinary sheet, the printing is executed by the sheet print routine (step S82) while in the case of an OHP sheet, an error message is displayed (step S83) and the compulsory sheet exhausting is executed (step S84).

In this respect, if the OHP selection button is depressed, only the printing on the basis of the manual sheet feeding is accepted, and the structure is arranged so as not to receive any sheet feeding from the cassette for stacking the recording medium.

According to the above-mentioned example embodying the present invention, the fixater is detachably mountable. Consequently, it is unnecessary for a user who does not use an OHP sheet to produce the fixater, thus enabling him to avoid an unnecessary increase of the operational cost.

Also, no ordinary sheet is passed through a fixater, thus preventing the deterioration of paper quality or the degradation of image quality, and at the same time, there is no effect of avoiding any jamming of an ordinary sheet in the fixater.

Figure 20:
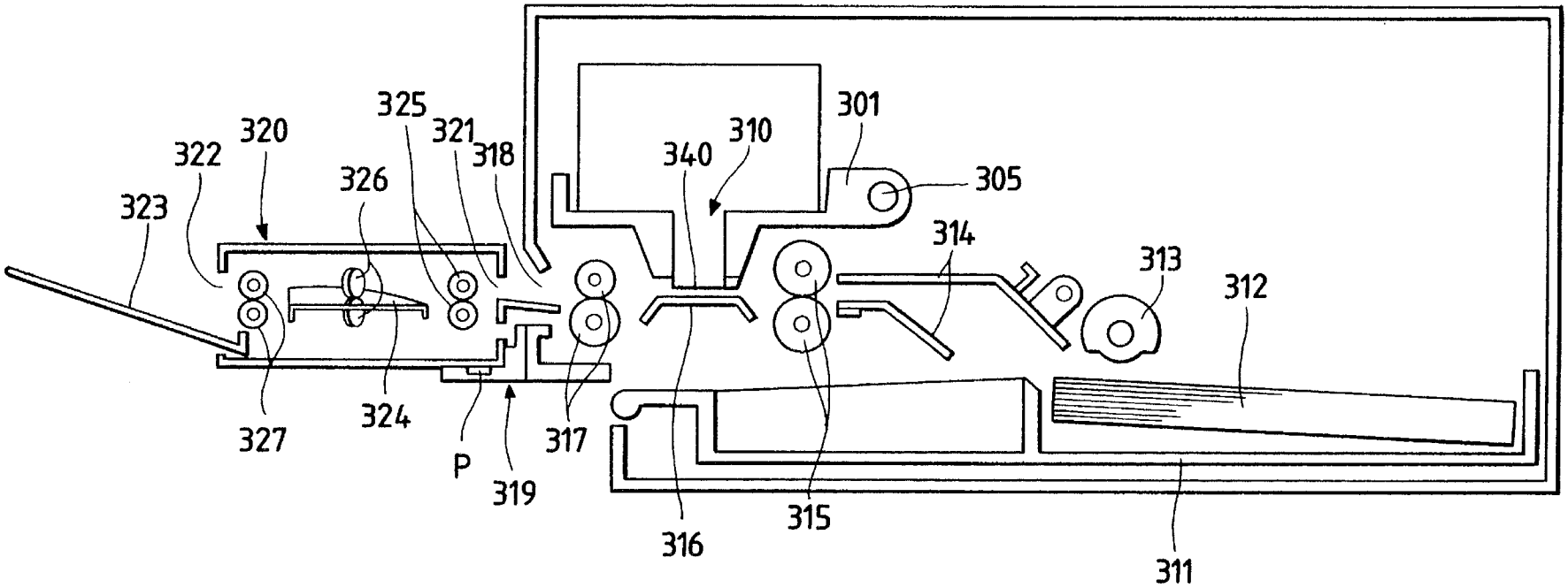
FIG. 20 is a cross-sectional view in the paper feeding direction of an eighth example embodying the recording apparatus according to the embodiment of the present invention.
Figure 21:
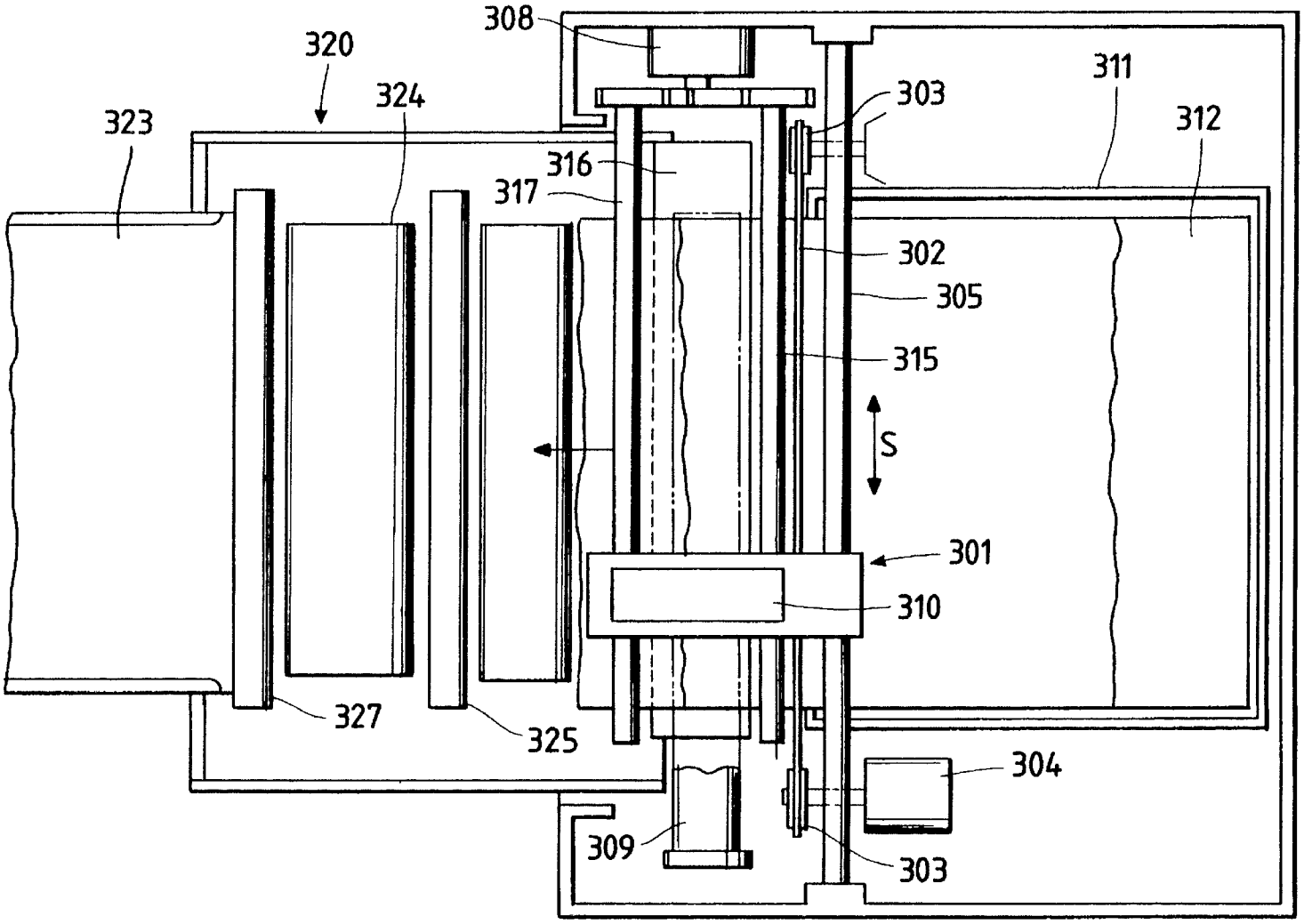
FIG. 21 is a plan view showing the inner structure of the recording apparatus shown in FIG. 20.

FIG. 20 is a vertically sectional view showing an eighth example of an recording apparatus embodying the present invention in the sheet conveying direction according to an embodiment of the present invention. FIG. 21 is a plan view showing the inner structure of the recording apparatus shown in FIG. 20.

In FIG. 20 and FIG. 21, a carriage 301 with a recording head 310 mounted is supported by a guide rail 305 to be guided to reciprocate in the directions indicated by arrow S.

The aforesaid carriage 301 can reciprocate by a carriage motor 304 in the directions indicated by arrow S through a wire 302 tensioned around a pair of pulleys 303 and 303.

The recording medium 312 such as paper or thin plastic sheet stored in a cassette 311 fed out one by one by a carrier roller 313 to be conveyed to between the carrier rollers 315 comprising a pair of rollers through guides 314.

The recording medium 312 conveyed to the carrier rollers 315 is further conveyed to between tension rollers 317 comprising a pair of rollers through a recording head 310 and platen 316.

The recording medium 312 thus supplied is caused by the carrier rollers 315 and tension rollers 317 to be in a tensioned state while the recording is performed by the recording head 310, and is being fed by a given pitch.

A reference numeral 340 designates the recording unit of the recording head 310.

The recorded recording medium 312 is fed out from the recording unit through an opening 318.

The aforesaid feed roller 313, carrier rollers 315 and tension rollers 317 are driven by a carrier motor 308 at a predetermined timing and peripheral velocity ratio respectively through a power transmission mechanism including gear trains, required clutch means and the like.

On the carriage 301, a flexible cable 309 is mounted as shown in FIG. 21 to transmit image data, control signals and the like between a control means (not shown) in the main body of the apparatus and the recording head 310.

In this respect, the recording head 310 in FIG. 20 and FIG. 21 is an ink jet recording head for discharging ink by the utilization of thermal energy and is provided with the electrothermal converter for generating the thermal energy.

Also, the aforesaid ink jet recording head 310 performs the recording by discharging ink from the discharging port by making use of the pressure changes resulting from the growth and contraction of a bubble caused by the film boiling generated by the application of the thermal energy by the aforesaid electrothermal converter.

In this example embodying the present invention, the recording head 310 is installed in the carriage 301 with such a positional relationship that the aforesaid discharging ports 342 are arranged in the direction intersecting the scanning direction of the carriage 301.

In FIG. 20 and FIG. 21, a fixater 320 is detachably mounted on the recording medium 312 outlet side of the aforesaid recording apparatus, i.e., at the side end of the said opening 318.

In FIG. 20, this fixater 320 is structured to allow the recording medium 312 to pass through its inside for conveyance, and there are provided an inlet 321 on the aforesaid opening 318 side and an outlet 322 on the opposite side. Then, at the aforesaid outlet 322, an exhaust sheet tray 323 is provided.

Here, in the inside of the fixater 320, there are provided a heated carrier pass or passage 324, and first carrier rollers 325, second carrier rollers 326, and third carrier rollers 327, each comprising a pair of rollers, respectively.

The second carrier rollers 326 positioned in the middle are arranged to guide the recording medium 312 correctly in the area of the heated carrier path 324.

Also, the exhaust sheet tray 323 mounted in the fixater 320 can be fixed to the fixater 320 or detachably mounted therein.

If the fixater is detachably mounted, the exhaust sheet tray which is dismounted from the recording apparatus may be mounted on the fixater 320 when the fixater 320 is mounted on the mounting section 319.

Each of the aforesaid carrier rollers 325, 326, and 327 are connected to the driving source (feed motor 308 and others) of the aforesaid recording apparatus through a driving power transmission mechanism (not shown) to be rotatively driven in a state where the fixater 320 is detachably mounted in the mounting section 319 of the recording apparatus. Therefore, these rollers can be controlled by a control means provided in the recording apparatus.

Also, the heater and other exothermic means for the aforesaid heated carrier pass 324 are connected to the control means in the recording apparatus, and are arranged to be actuated by the energizing control thereof.

In the above-mentioned recording apparatus, a sensor means P is provided in the mounting section 319 to detect whether or not the fixater 320 is mounted.

As to this fixater sensing means, various types of sensors may be employed if only a detecting output is obtainable. For example, switches mechanically, magnetically, or optically actuated may be used.

Also, in the above-mentioned recording apparatus, a recording medium discrimination means (FIG. 14) is provided for discriminating whether the supplied recording medium 312 is an ordinary sheet or an OHP sheet.

Furthermore, in the above-mentioned recording apparatus, a switching means (FIG. 15) is provided for switching the feeding mechanisms on the basis of whether the recording medium 312 is an ordinary sheet or an OHP sheet.

With the structure set forth above, it is possible to provide a recording apparatus according to this example embodying the present invention, i.e., the recording apparatus for recording an image on a recording medium 312 by the recording means 310, having a mounting section 319 for detachably mounting a fixater 320 for expediting the fixation of the image recorded on the recording medium 312, a detecting means P for detecting the mounting of the aforesaid fixater 320 in the recording apparatus, and recording medium discrimination means 331, 332, and 333 for discriminating whether the aforesaid recording medium 312 is an ordinary sheet or an OHP sheet, and characterized in that even in the case where the aforesaid recording medium 312 is not an ordinary sheet, the recording is performed irrespective of the presence of the aforesaid fixater 320.

Figure 22:
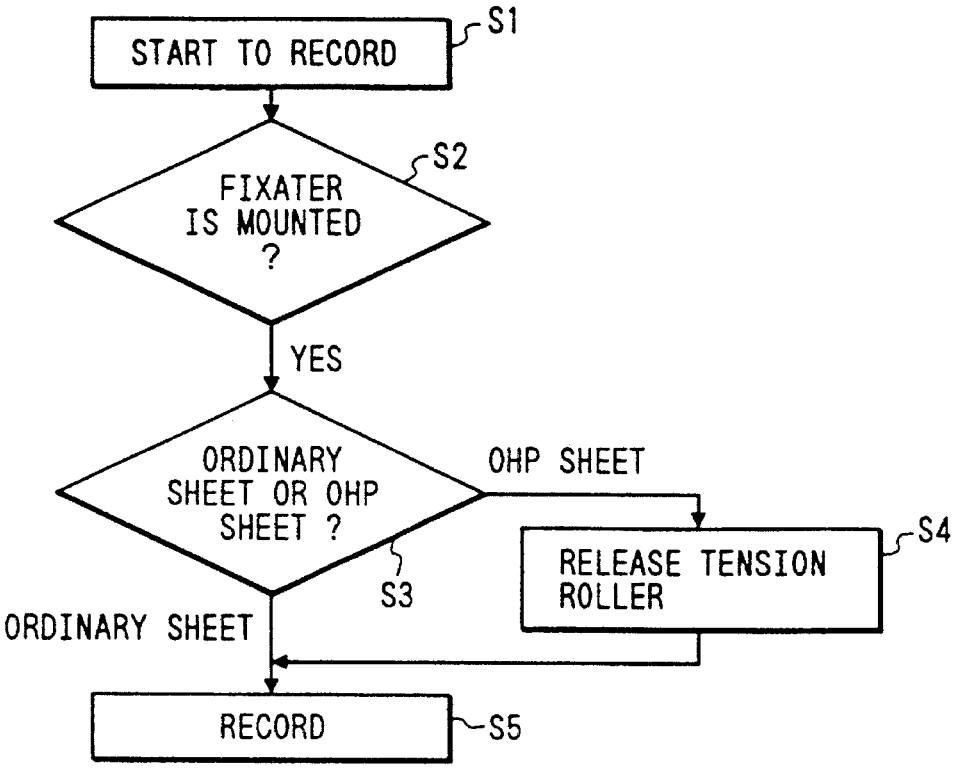
FIG. 22 is a flowchart showing the control operation for the paper feed mechanism of the recording apparatus shown in FIG. 20.

FIG. 22 is a flowchart showing the control operation of the feeding mechanism of the recording apparatus described above.

Here, in this flowchart, the description will be made of the operation in the case where the fixater 320 has been mounted.

In FIG. 22, when an instruction to start the recording is received at the step S1, the presence of the fixater 320 is discriminated at the step S2 on the basis of the signal from the sensor P. Then, at the step S3, whether the recording medium 312 is an ordinary sheet or an OHP sheet is discriminated on the basis of the signal from the sensor 331.

In the case of the OHP sheet, the process proceeds to the step S4 to release the tension roller 217 (317) as shown in FIG. 15B. Then, the recording operation at the step S5 is started.

If the recording medium is discriminated to be an ordinary sheet at the step S3, the process proceeds to the step S5 to start the recording.

Figure 23:
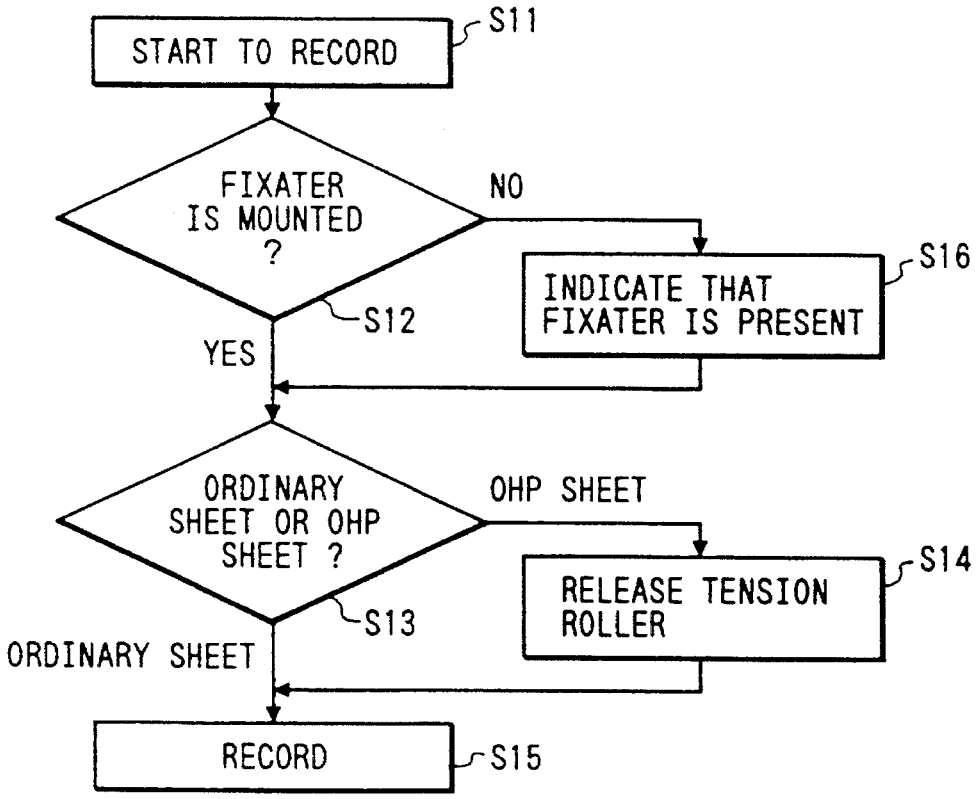
FIG. 23 is a flowchart showing the control operation including the case where an OHP sheet is recorded without the fixater of the recording apparatus shown in FIG. 20.

FIG. 23 is a flowchart showing the control operation including a case where the recording is performed on an OHP sheet in a state that the fixater 320 is not mounted in the mounting section 319.

In FIG. 23, when an instruction to start the recording is received at the step S11, the presence of the fixater 320 is discriminated at the step S12 on the basis of the signal from the sensor P.

In the case of the fixater 320 being mounted, the process is the same as in the case of FIG. 22. Then, at the step S13, whether the recording medium 312 is an ordinary sheet or an OHP sheet is discriminated on the basis of the signal from the sensor 331. In the case of the OHP sheet, the tension roller 217 (317) is released as shown in FIG. 15B at the step S14. Then, the recording operation at the step S15 is started.

If the recording medium is discriminated to be an ordinary sheet at the step S13, the process proceeds to the step S15 to start the recording.

On the other hand, if the presence of the fixater 320 is not indicated at the step S12, the process proceeds to the step S16 to warn the operator 10 that the fixater is not mounted by displaying the message accordingly.

This display of no fixater message can be made by a method of displaying such message or the like in the operation unit if the recording apparatus is a copying machine or a facsimile apparatus, for example.

Also, in the case of a printer, a method to transmit the corresponding command to the host computer or to display such a message in the operation unit of the aforesaid printer may be applicable.

Thus, subsequent to the no-fixater display, whether the recording medium 312 is an ordinary sheet or an OHP sheet is discriminated at the step S13 as described earlier, and in the case of the OHP sheet, the tension roller 217 (317) is released at the step S14 as shown in FIG. 15B. Then, at the step S15, the recording operation is executed. If the recording medium is discriminated to be an ordinary sheet at the step S13, the process proceeds to the step S15 to execute the recording operation.

According to the embodiment set forth above, it is possible for the user to perform the recording on an OHP sheet irrespective of the presence of the fixater 320, and if the fixater is provided, the user finds it unnecessary to wait for the drying of the recorded ink. Therefore, the apparatus can be used most advantageously in accordance with the various cases, thus implementing the provision of a recording apparatus which is superior in its handling.

Here, in the above-mentioned embodiment, although the description has been made of the application of the present invention mainly to the ink jet recording apparatus, the present invention is applicable to a recording apparatus of some other recording type which requires a fixation, and the same effects can also be obtained.

Also, in the above-mentioned examples embodying the present invention, the description has been made of the image recording apparatus of a serial type where the recording head 310 is installed on the carriage 301 movable along the recording medium 312 to perform the main scanning in the width direction of recording sheet. The present invention, however, is equally applicable to an image recording apparatus of a line type where a line recording head is used to cover the entire or a part of the recording area in the paper width direction so that the same effects can also be obtained.

Furthermore, in the above-mentioned examples embodying the present invention, the description has been made of the case where the image recording apparatus performs the recording with only one recording head 310. The present invention, however, is equally applicable, irrespective of the number of the recording heads, to a color image recording apparatus having a plurality of recording heads for recording in different colors, or an image recording apparatus for a tonal recording using a plurality of recording heads for performing the recording in the same color but different densities or the like, and the same effects can also be obtained.

Also, as the recording head 310 in the above-mentioned examples embodying the present invention, it is possible to use a recording head of a cartridge type with the recording unit and ink reservoir being integrally constructed or with the recording unit (ink discharging unit and others) and the ink reservoir (ink tank and others) being separately arranged such as a recording head constructed by coupling a coupler and tube, or a recording head structured by only a recording unit without any ink reservoir or various other types of recording heads.

According to the above-mentioned example embodying the present invention set forth above, it is possible to provide a recording apparatus capable of performing the recording on the recording medium which is not an ordinary sheet irrespective of the presence of a fixater, drying a recorded image without the requirement of any waiting if a fixater is mounted, and enabling an advantageous process to be taken in either case.

Figure 24:
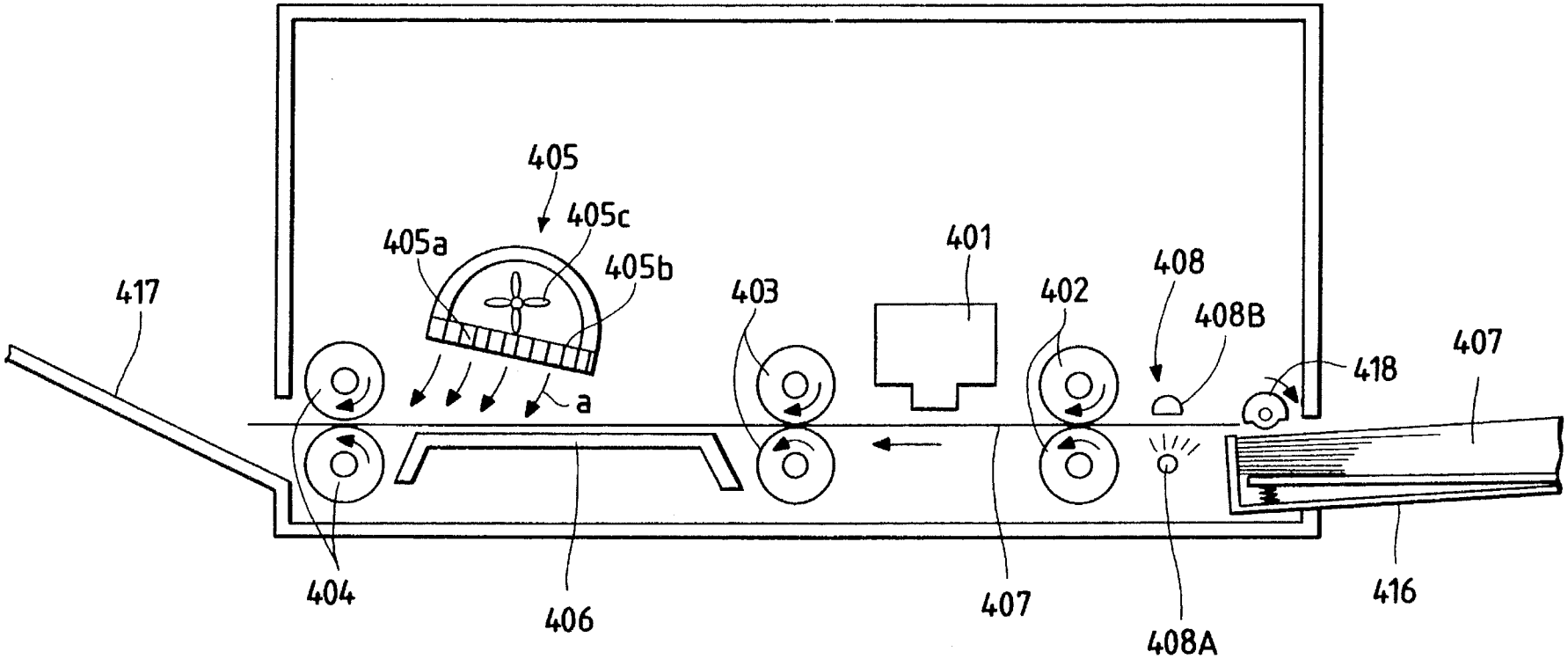
FIG. 24 is a vertically sectional view schematically showing a ninth example embodying the present invention.

FIG. 24 is a vertically sectional view schematically showing the structure of a ninth example embodying an ink jet recording apparatus as an embodiment according to the present invention.

In FIG. 24, a reference numeral 401 designates a recording means (recording head) for performing the recording by discharging ink onto a recording medium 407; 402, carrier rollers comprising a pair of rollers for conveying the recording medium 407 through the opposite portion (lower side in FIG. 24) of the recording means 401; 403, first exhaust sheet rollers comprising a pair of rollers; 404, second exhaust sheet rollers comprising a pair of rollers for exhausting the recorded recording medium 407; and 405, a drying fixater comprising a hot air fan for drying ink recorded on the recording medium with blowing ports 405*a* diagonally installed to blow hot air in the conveying direction of the recording medium 407 (the direction indicated by arrow a).

A reference numeral 406 designates a recording medium supporting member for supporting the reverse side of the recording medium 407 between the first exhaust sheet rollers 403 and the second exhaust sheet rollers 404, and is provided facing the aforesaid fixater 405.

Here, a reference numeral 416 designates a cassette for storing the recording medium 407. The recording medium 407 stored in the cassette 416 is fed out to the recording position by a feed roller 418.

Also, a reference numeral 417 designates an exhaust sheet tray.

Here, in this example embodying the present invention, there is arranged on the upstream side of the sheet conveying direction of the carrier rollers 402 a rear portion detecting means 408 consisting of a light emitting element 408A and light receiving element 408B for detecting the rear portion of the recording medium 407.

Then, the structure is arranged to input the detecting signal from the aforesaid rear portion detecting means 408 into a fixater driving condition switching device 409 to enable the driving condition of the fixater 405 to be changed by the aforesaid switching device 409.

In the respect, the aforesaid recording head 401 is an ink jet recording head for discharging ink by the utilization of thermal energy and is provided with the electrothermal converter for generating the thermal energy.

Also, the aforesaid recording head 401 performs the recording by discharging ink by making use of the pressure changes resulting from the growth and contraction of a bubble caused by the film boiling generated by the thermal energy applied by the electrothermal converter.

Figure 25:
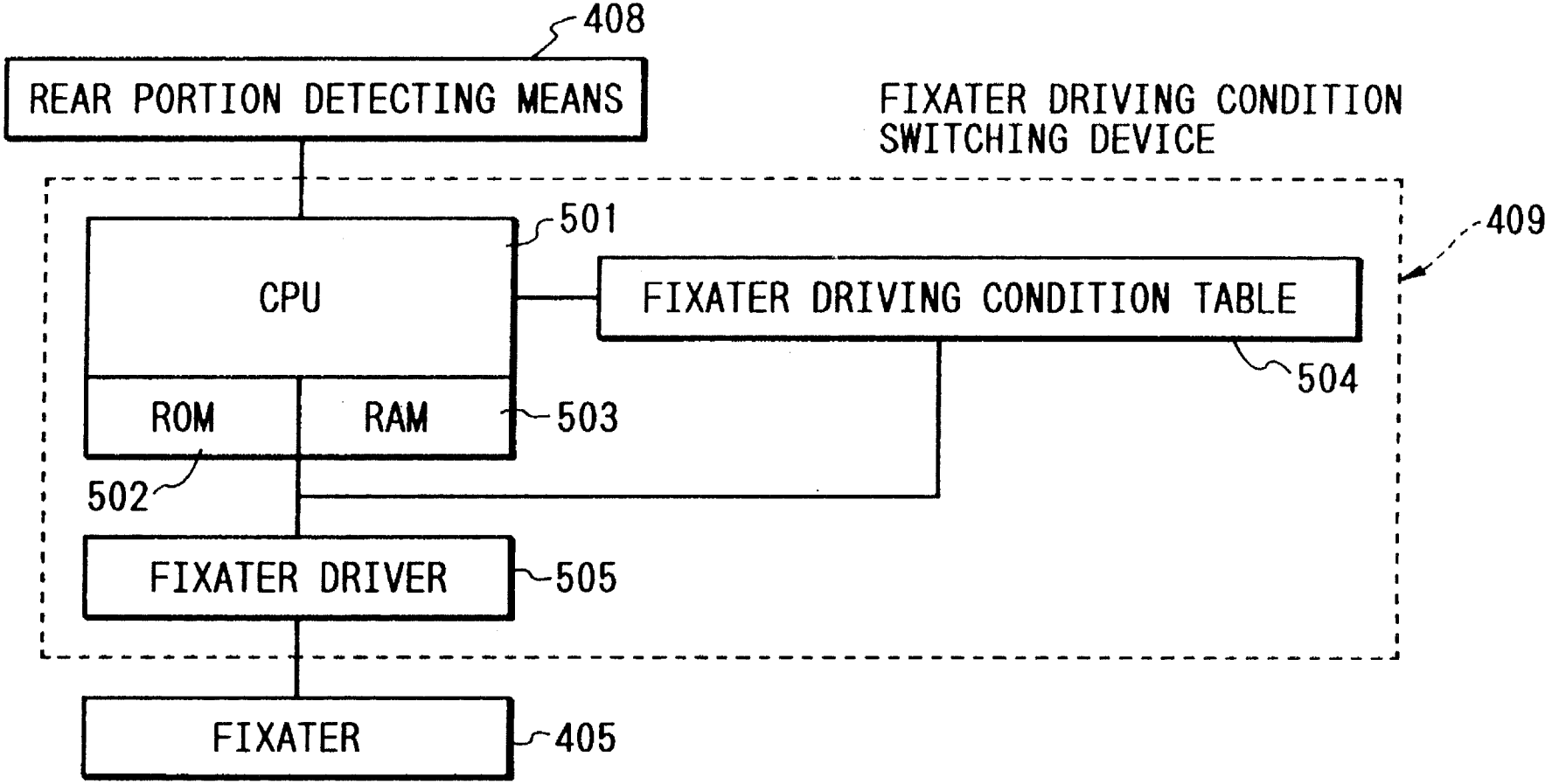
FIG. 25 is a block diagram schematically showing the functional structure of the fixing means for the control system of the recording apparatus shown in FIG. 24.

FIG. 25 is a functional block diagram schematically showing the functional structure of the control unit for the aforesaid fixater driving condition switching device 409.

Figure 26:
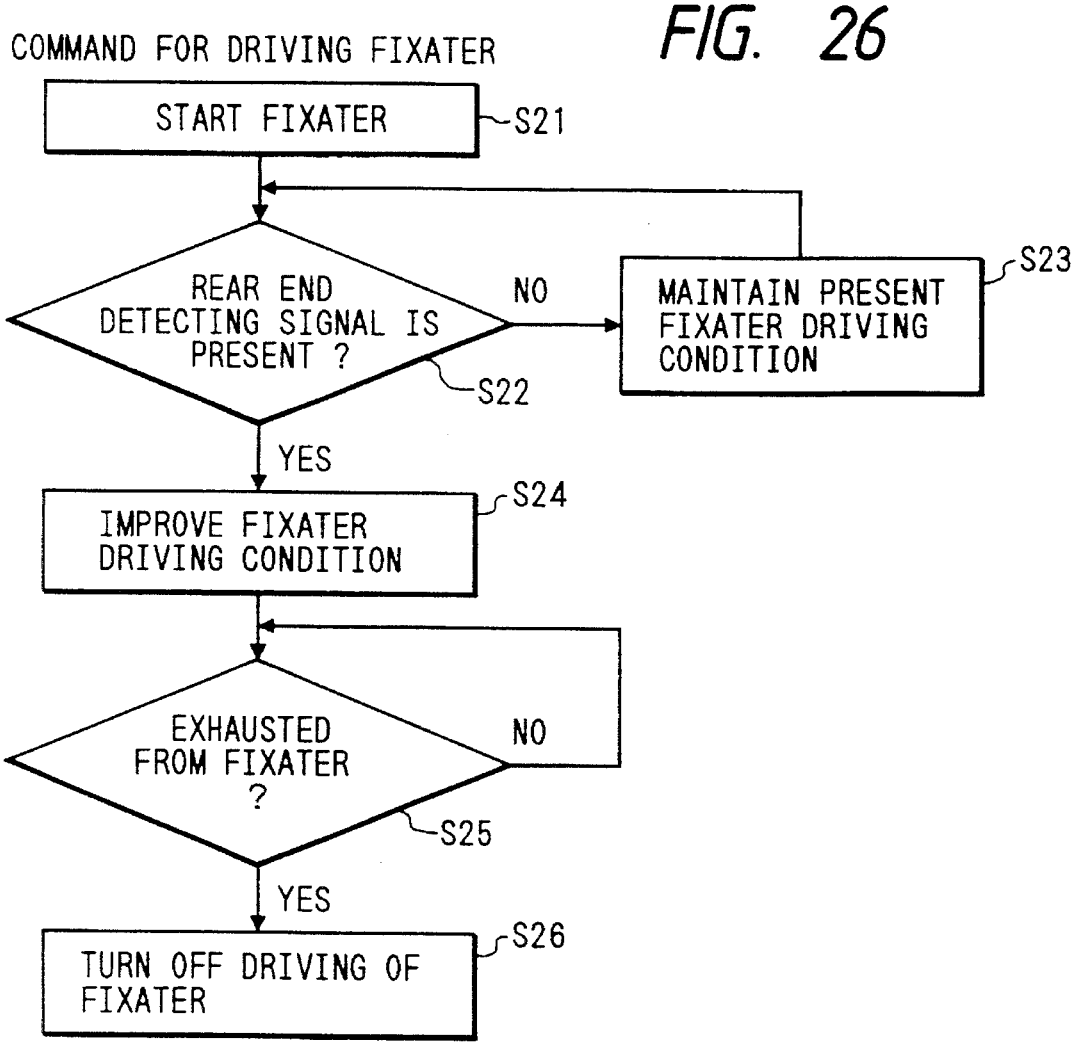
FIG. 26 is a flowchart showing the sequence of the control operation of the fixing means of the recording apparatus shown in FIG. 24.

In FIG. 25, the fixater driving condition switching device 409 is provided with a CPU 501 of a microprocessor or the like, for example, ROM 502 storing the control program for the CPU shown by a flowchart in FIG. 26 as well as various data, RAM 503 to be used as work area for the CPU 501 and for temporarily storing various data, and others.

To the aforesaid CPU 501, a detecting signal is inputted from the rear portion detecting means 408 for detecting the rear portion of the recording medium 407.

Then, the structure is arranged so that when this rear portion detecting signal is inputted into the CPU 501, a predetermined driving condition is read from a fixater driving condition table 504, and on the basis of the aforesaid driving condition, the fixater driver 505 is controlled to drive the fixater 405.

The operation of each unit of the ink jet recording apparatus according to this example embodying the present invention is given below.

The recording medium 407 is conveyed in the direction indicated by arrow while being provided with an appropriate tension by the carrier rollers 402 and the first exhaust sheet rollers 403, during the period of which, the image is recorded by ink being discharged from the recording head 401.

The recording medium 407 having passed through the first exhaust sheet rollers 403 reaches the second exhaust sheet rollers 404 while being supported by the recording medium supporting member 406, during the period of which the drying fixation of the ink recorded on the recording medium is executed with the hot air blowing thereupon from the hot air fan fixater (drying fixater) 405 consisting of a heater and circulating fan.

When the recording medium 407 is conveyed for a predetermined amount and the rear portion of the recording medium 407 is detected by the rear portion detecting device 408, the switching signal is transmitted from the aforesaid rear portion detecting device 408 to the fixater driving condition switching device 409.

When the driving condition switching device 409 has received the switching signal, the fixater driving condition is switched to a predetermined drying fixater driving condition to enhance the drying fixation.

At this juncture, if the hot air fan 405 is employed as in the case of this example embodying the present invention, the drying fixation condition can be enhanced by raising the heater temperature or by speeding up the fan velocity while keeping the temperature at a constant level.

Hence, it is possible to perform the reliable drying fixation over the entire area of the recording medium 407 by enhancing the fixation effect in the rear portion of the recording medium 407 while minimizing the energy consumption.

FIG. 26 is a flowchart showing the operational sequence of the aforesaid fixater driving condition switching device 409.

In FIG. 26, when the fixater is actuated by the fixater 405 actuation instruction at the step S21, the presence of a signal (rear portion detecting signal) from the rear portion detecting means 408 is discriminated at the step S22.

In the case of no rear portion detecting signal, the fixater driving condition is fixed as is the current status at the step S23.

If there is a rear portion detecting signal, the process proceeds to the step S24 to switch the fixater driving condition so as to enhance the fixation effect.

Subsequently, at the step S25, whether or not the recording medium 407 has been exhausted from the fixater 405 is discriminated.

Until the recording medium 407 is exhausted, the fixater 405 is driven on a condition for the high fixation effect, and when the recording medium 407 has been exhausted, the process proceeds to the step S26 to suspend the driving of the fixater 405.

Next, the result of an experiment on the drying fixation condition set forth above will be described.

In this experiment, the ink jet head of an ink jet printer BJC 430 manufactured by Canon Incorporated is used as the recording head 401, and ink (water system ink including non-volatile soluble) for the ink jet printer BJC 430 as the ink for the experiment. As the recording medium 407, PET films of 75 μm thick are used each with PVA resin coated on one side thereof in a thickness of 10 μm.

Also, as the drying fixater 405, a fixater produced by combining a circulating fan **405*c* of 30 mm diameter and a nichrome wire heater 405*b* is used, and the aforesaid circulating fan 405*c*** is driven at 1,000 rpm for several minutes.

This experiment is conducted under ambient conditions of a room temperature of 23° C. with 60% humidity.

At first, the conveying velocity of the recording medium 407 is set at 5 mm/second when the recording is performed while the electric consumption of the nichrome wire heater **405*b* is fixed at 100 W. Immediately after the recording medium 407 is exhausted onto the tray 417**, the rear portion thereof is touched by a finger. Then, the recorded image is smeared, and the hand is stained with ink.

Next, this example embodying the present invention described earlier is applied and the experiment is conducted.

In other words, during the period for the rear portion of the recording medium 407 of 50 mm long to pass through the fixater 405, the driving voltage is switched so that the revolution of the circulating fan **405*c* of the fixater 405** can be increased to 3,000 rpm to increase the wind velocity.

As a result, the recorded medium is obtained with no image being smeared even when the recorded image is touched by a finger immediately after the recording medium 407 has been exhausted onto the tray 417. No ink has adhered to the hand, either.

The power consumption for this example embodying the present invention thus applied is approximately a half as compared with the power consumption required for the circulating fan to be driven at 3,000 rpm to cover the entire recording area of the recording medium.

Also, the driving period for the high-speed rotation can be shortened. Therefore, there is more freedom in selecting a fan including its driving system, thus making it possible to implement the miniaturization of the recording apparatus as well as the reduction of the manufacturing cost.

Figure 27:
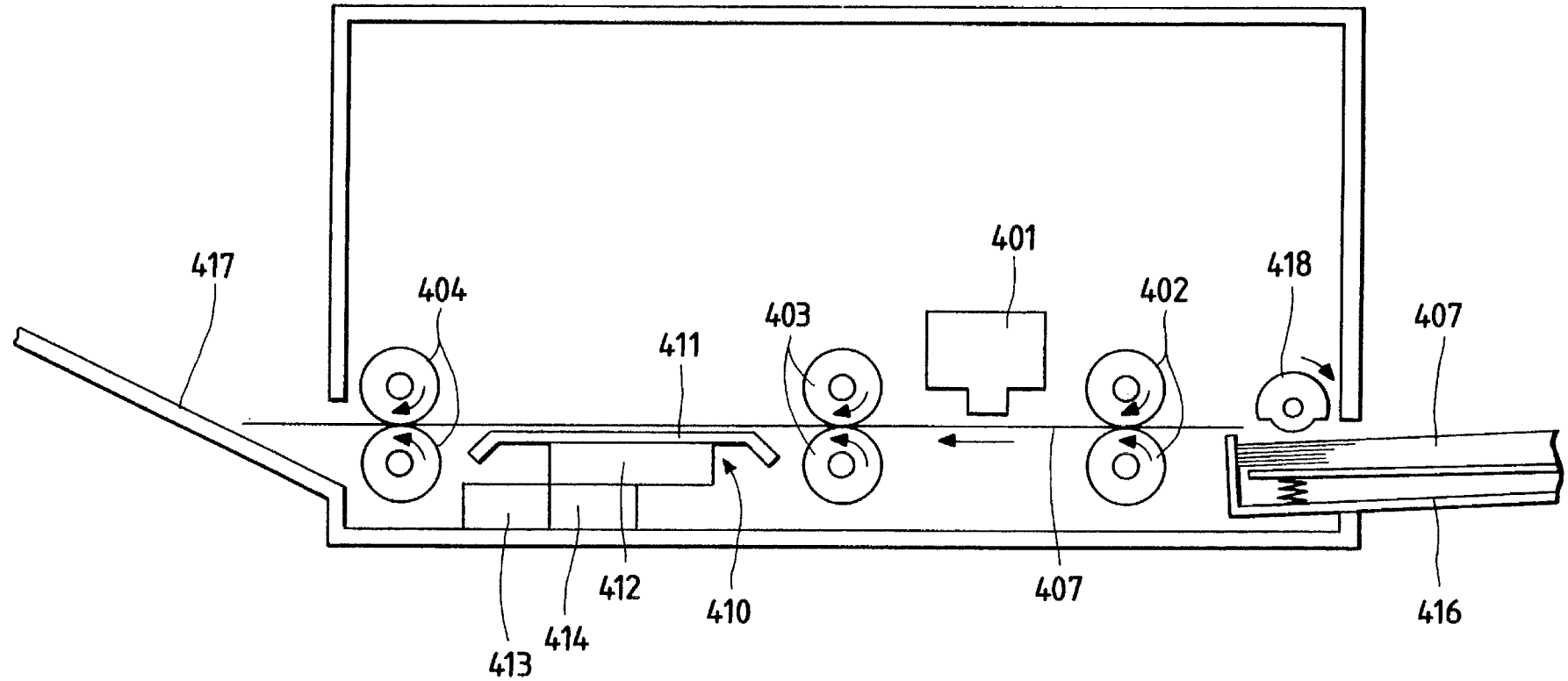
FIG. 27 is a vertically sectional view schematically showing a tenth example embodying the present invention.

FIG. 27 is a view schematically showing the structure of a tenth example embodying an ink jet recorder according to the embodiment of the present invention.

In FIG. 27, a reference numeral 401 designates a recording head for performing the recording by discharging ink onto a recording medium 407; 402, carrier rollers consisting of a pair of rollers for conveying the recording medium 407 through the opposite portion (lower part in FIG. 27) facing the recording head 401; 403, first exhaust sheet rollers consisting of a pair of rollers; and 404, second exhaust rollers consisting of a pair of rollers for exhausting the recorded recording medium 407. These are essentially the same as in the case of FIG. 24.

Now, in this example embodying the present invention, a drying fixater 410 formed by a reverse side heater plate is arranged between the first exhaust sheet rollers 403 and second exhaust sheet rollers 404.

This reverse side heater plate 410 comprises a plate member 411 with an excellent heat conductivity and a heater 412 coupled to the aforesaid plate member in a thermal coupling state.

The recording medium 407 is conveyed by the first exhaust rollers 403 and second exhaust rollers 404 in a state that the recording medium is in contact with the aforesaid reverse side heater plate 410 (plate member 411).

Therefore, the recorded recording medium 407 is heated from the reverse side thereof while being conveyed, and the drying fixation of the recorded ink is executed.

In FIG. 27, a reference numeral 413 designates a counter control device which as its input receives the input signal of a pulse motor (not shown) for driving the carrier rollers 402; and 414, a driving condition switching device for switching drying fixater driving conditions.

Now, in this example embodying the present invention, the structure is arranged to control the switching of the driving conditions of the aforesaid reverse side heater plate (drying fixater) 410 with the aforesaid counter control device 413 and drying fixater driving condition switching device 414.

Figure 28:
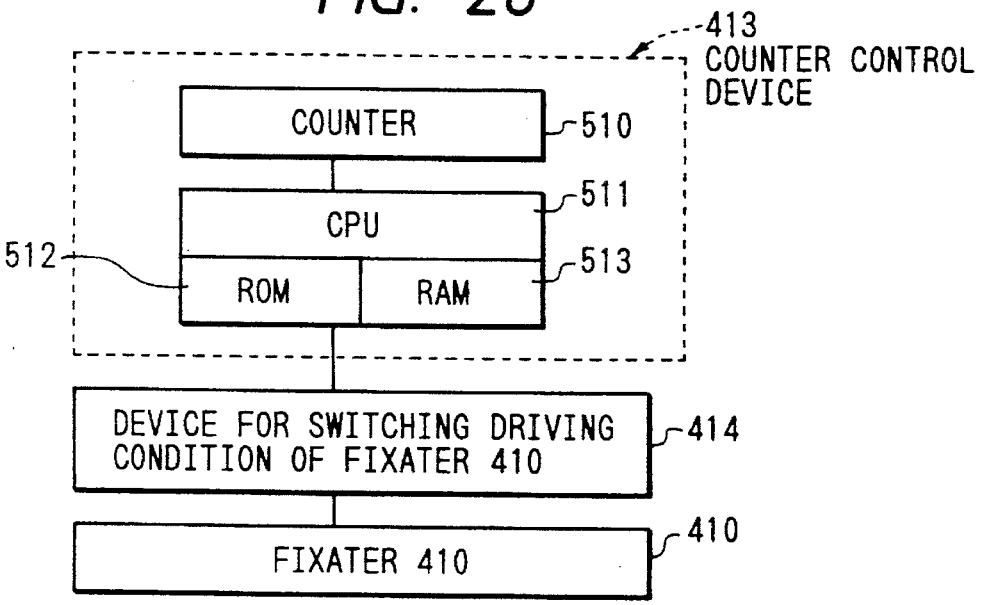
FIG. 28 is a block diagram schematically showing the functional structure of the fixing means for the control system of the recording apparatus shown in FIG. 27.

FIG. 28 is a functional block diagram schematically showing the functional structure of the control system of the fixater 410 in the recording apparatus shown in FIG. 27.

Figure 29:
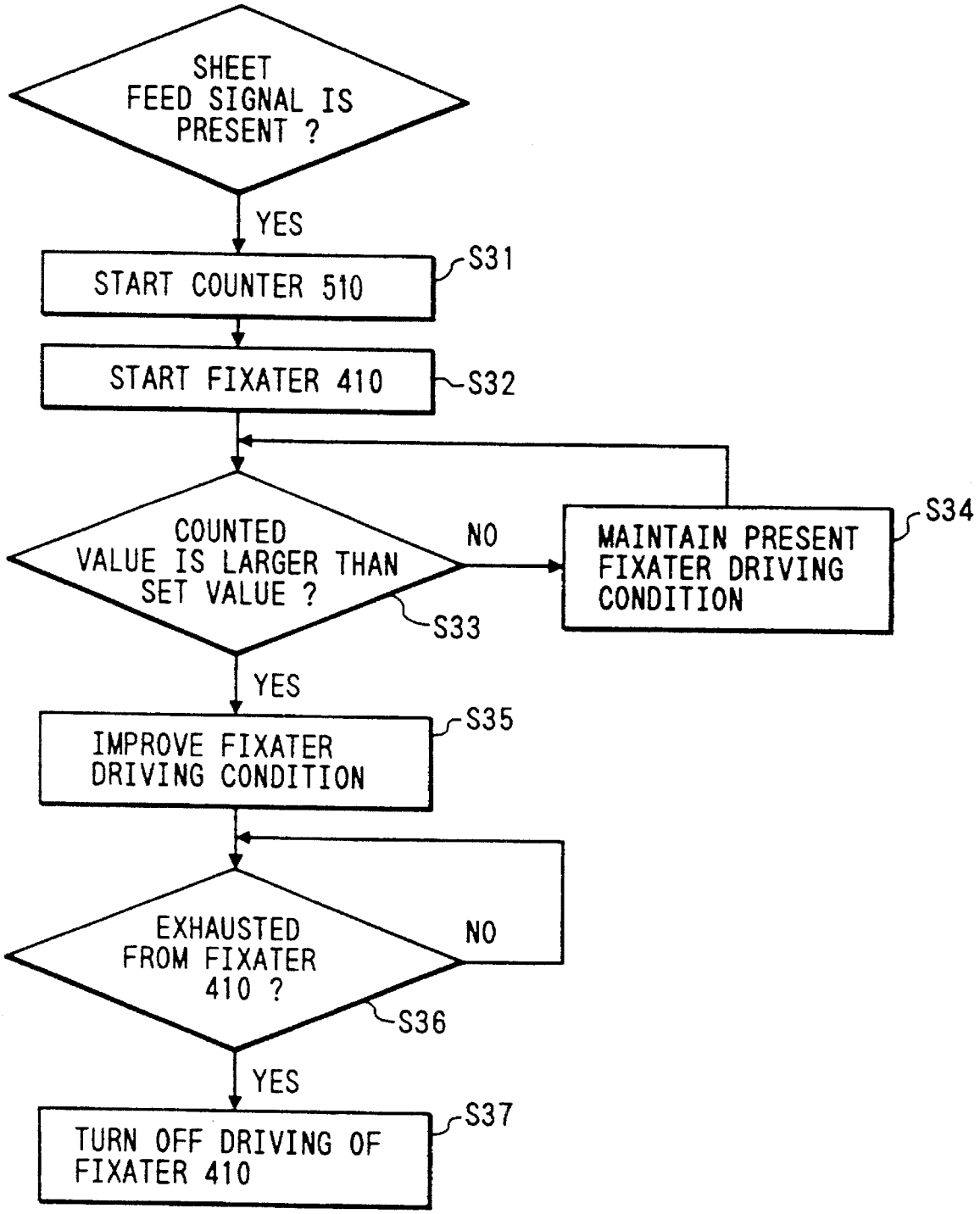
FIG. 29 is a flowchart showing the sequence of the control operation of the fixing means of the recording apparatus shown in FIG. 27.

In FIG. 28, the counter control device 413 is provided with a counter 510, CPU 511 of a microprocessor and others, for example, ROM 512 for storing the CPU control program shown by a flowchart in FIG. 29 as well as various data, and RAM 513 to be used for work area for the CPU 511 and for temporarily storing various data, and others.

The aforesaid counter 510 counts the pulse numbers corresponding to the conveying amount of the recording medium 407 since the time of its feeding.

The counter control device 413 transmits a signal to the fixater driving condition switching device 414 when the counter 510 has counted predetermined pulse numbers.

This driving condition switching device 414 is structured to switch the driving condition of the fixater (reverse side heater plate) 410 to a predetermined condition when the aforesaid signal is received so as to enhance the drying fixation condition.

The operation of each part of the ink jet recording apparatus according to this example embodying the present invention is given below.

The recording medium 407 is conveyed in the direction indicated by arrow while being provided with an appropriate tension by the carrier rollers 402 and first exhaust sheet rollers 403, during the period of which an image is recorded thereon by ink being discharged from the recording head 401.

The recording medium 407 having passed through the first exhaust sheet rollers 403 reaches the second exhaust sheet rollers 404 while being supported by the reverse side heater plate 410, during the period of which the drying fixation of the recorded ink on the recording surface is executed by the aforesaid reverse side heater plate 410.

The aforesaid counter control device 413 starts its operation at the time of feeding the recording medium 407 to continue it during the conveyance of the recording medium 407 and counts the pulse numbers corresponding to the conveying amount of the recording medium 407.

Then, this counter control device 413 transmits a signal to the aforesaid drying fixater driving condition switching device 414 when the predetermined pulse numbers (the time for the desired rear portion of the recording medium 407 to reach the heater plate 410) have been counted.

This driving condition switching device 414 switches the driving condition of the aforesaid reverse side heater plate 410 to a predetermined condition when the aforesaid signal is received so as to enhance the drying fixation condition.

In the case where a reverse side heater plate is used for the drying fixater 410 as in this example embodying the present invention, it is possible to enhance the drying fixation condition by raising the heater temperature by increasing the exothermic volume with a high voltage applied to the heater 412.

Therefore, by arranging the signal transmitting timing of the aforesaid counter control device 413 to match he timing of the rear portion of the recorded recording medium 407 to arrive at the reverse side heater plate 410, it is possible to enhance the drying fixation effect on the rear portion of the aforesaid recording medium 407.

Thus, by enhancing the fixation effect on the rear portion of the recording medium 407, it becomes possible to execute the drying fixation over the entire area of the recording medium 407 reliably.

FIG. 29 is a flowchart showing the operational control sequence of the fixater 410 set forth above.

In FIG. 29, when the sheet carrier signal is given, the counter 510 is started at the step S31 to actuate the fixater 410 at the step S32.

Then, at the step S33, whether or not the counting value of the counter 510 has arrived at a predetermined value is discriminated.

If the counting has not arrived at the predetermined value, the driving condition of the fixater 410 is fixed at the current level as it is at the step S34.

When the counted value has reached the predetermined value, the process proceeds to the step S35 to switch the fixater driving condition so as to enhance the fixation effect.

Subsequently, at the step S36, whether or not the recording medium 407 has been exhausted from the fixater 410 is discriminated.

Until the recording medium 407 is exhausted, the fixater 410 is driven on a condition for a high fixation effect, and when the recording medium 407 is exhausted, the process proceeds to the step S37 to suspend the driving of the fixater 410.

Next, the result of an experiment on the drying fixation condition set forth above will be described.

In this experiment, as in the previous experiment for the aforesaid example embodying the present invention, the ink jet head of an ink jet printer BJC 430 manufactured by Canon Incorporated is used as the recording head 401, and ink (water system ink including non-volatile soluble) for the ink jet printer BJC 430 as the ink for the experiment. As the recording medium 407, PET films of 75 μm thick are used each with PVA resin coated on one side thereof in a thickness of 10 μm.

Now, the experiment is conducted at first by fixing the surface temperature of the reverse side heater plate 410 at 80° C. with the conveying velocity of the recording medium 407 at 5 mm/second.

Under this condition, the fixation results desirably, provided that the room temperature is 23° C. with 50% humidity. However, when only the humidity is increased to 80%, the fixation on the rear portion of approximately 40 mm is not complete, and there is observed a drawback such that the recorded image is smeared and the hand is stained with ink if that portion is touched by a finger immediately after the recording medium 407 has been exhausted.

Then, this example embodying the present invention described earlier is applied and the experiment is conducted.

In other words, the time for the rear portion of the recording medium 407 of 40 mm long to pass through the fixater 410 is detected by the counter control device 413, and the driving voltage of the heater 412 is switched by the drying fixation condition switching device 414 to adjust the surface temperature of the reverse side heater plate 410 to 110° C.

Then, it becomes possible to complete the fixation over the entire area of the recording medium 407 in an ambient condition of the room temperature at 23° C. with 80% humidity.

The power consumption for this example embodying the present invention thus applied is approximately 30% less than that required when the temperature adjustment to 110° C. is conducted over the entire area of the recording medium 407 thereby to implement the energy savings.

Also, the time required for the temperature to arrive at the standard adjustment temperature (in this experiment, 80° C.), i.e., a standby time, is shortened by approximately 40% as compared with the case where the standard adjustment temperature is established at 100° C.

Furthermore, as the period required for keeping the high temperature (in this experiment, 110° C.) can be shortened, there is more freedom in selecting the material of the heater 413, thus making it possible to miniaturize the recording apparatus as well as to lower the manufacturing cost.

Here, in each of the examples embodying the present invention, the heating dry fixation means (hot air fan and reverse side heater plate) is employed as a fixing means, the optical means or counter control means is employed as a rear portion detecting means, and the switching means for wind velocity or heater temperature is employed as a driving condition switching means. The present invention, however, is not limited to these means, and it may be possible to use some other means for implementation if only the same effect can be obtained.

Also, in each of the aforesaid experiments, a specific coated sheet is used as the recording medium 407, but the present invention is equally applicable to the recording on an ordinary sheet (PPC sheet) or cloth, resin, or the like where there is a problem concerning the fixing property of the recording medium, and the same functional effect is obtainable in any one of such recording media.

According to the examples embodying the present invention set forth above, the structure is arranged to switch the driving conditions of the fixaters 405 and 410 so as to enhance the fixation effect on the rear portion of the recording medium 407. Therefore, while implementing the energy savings, it is possible to perform the fixation reliably over the entire area of the recording medium 407 including the rear portion thereof as well as to provide an ink jet recording apparatus for which the miniaturization of the fixater and cost reduction are achieved.

Also, the present invention is applicable to a serial type where the recording head 401 is moved along the recording medium 407 to perform the scanning in the width direction of recording sheet or the line recording method using a recording head having the length corresponding to the width of recording area of the recording medium 407 and the like, and the same effects can be obtained irrespective of the kinds of the recording methods.

Also, as the aforesaid recording head 401, it is possible to use a recording head of a replaceable cartridge type with the recording unit and ink reservoir being integrally constructed or with the ink discharging unit and the ink tank being separately arranged such as a recording head constructed by coupling a coupler and tube, or a recording head structured by only a recording unit without any ink tank, or any other types of recording heads, and the same effect can be obtained.

Furthermore, in the above-mentioned embodiment, the description has been made of the case where one recording head 401 is used. The present invention, however, is equally applicable, irrespective of the number of the recording heads, to a color image recording using a plurality of recording heads for recording in different colors, or to a tonal recording using a plurality of recording heads for performing the recording in the same color but different densities or the like, and the same effects can also be obtained.

As clear from the descriptions set forth above, according to this example embodying the present invention, it is possible to provide an ink jet recording apparatus capable of performing ink fixation over the entire area of the recording medium including the rear portion thereof reliably while controlling the energy consumption.

The present invention is efficient in producing an excellent effect on the recording head and recording apparatus of the ink jet recording method, particularly the one using the method for performing the ink jet recording by forming flying droplets by the utilization of the thermal energy.

For the typical structure and principle thereof, it is preferable to adopt for its implementation the fundamental principle disclosed, for example, in the specifications of U.S. Pat. Nos. 4,723,129 and 4,740,796. This method is applicable to either so-called on demand type and continuance type. Particularly, in the case of the on demand type, at least one driving signal, which gives a recording liquid a rapid temperature rise exceeding the nucleate boiling point, is applied in response to the recording information provided for the electrothermal converter arranged with respect to a sheet or liquid path holding a recording liquid (ink) thereby causing the electrothermal converter to generate thermal energy. Hence, film boiling is generated on the thermoactive plane of the recording head, resulting in the formation of a bubble in the recording liquid (ink) one to one in response to this driving signal efficiently. The recording liquid (ink) is discharged into the atmosphere through the discharging port by the active force generated in the course of the growth and contraction of this bubble to form at least one droplet. It is more preferable to produce this driving signal in the form of pulses. Then, the growth and contraction of the bubble is appropriately performed instantaneously to implement the discharging of recording liquid (ink) having particularly excellent responsiveness.

For this pulse type driving signal, the one such as disclosed in the specifications of U.S. Pat. Nos. 4,463,359 and 4,345,262 is suitable. In this respect, if the condition disclosed in the specification of U.S. Pat. No. 4,313,124 concerning the invention as regards the temperature rise on the above-mentioned thermoactive plane, it is possible to perform an excellent recording in a better condition.

At the structure of the recording head, the present invention includes a combination of the discharging port, liquid path, electrothermal converter (linear liquid path or rectangular liquid path) such as disclosed in each of the above-mentioned specifications as well as the structure having the thermoactive portion arranged in the bending region using the configuration disclosed in the specifications of U.S. Pat. Nos. 4,558,333 and 4,459,600.

In addition, the present invention is also efficient with the structure to be arranged on the basis of the Japanese Patent Laid-Open Application No. 59-123670 in which a common slit is structured as a discharging unit of electrothermal converters with respect to a plurality of electrothermal converters or the Japanese Patent Laid-Open Application No. 59-138461 which an opening for absorbing the pressure wave of thermal energy is constructed with respect to the discharging unit.

Further, as to the full-line type recording head having a length corresponding to the maximum width of the recording medium on which the recording apparatus can perform its recording, there may be a structure to attain such length by combining a plurality of recording heads such as disclosed in the above-mentioned specifications or a structure to attain such length by a single recording head integrally constructed. In either case, the present invention can display the above-mentioned effects more efficiently.

In addition, the present invention is efficient in using a freely replaceable chip type recording head for which the electrical connection to the main body of the recording apparatus and ink supply become possible when it is installed therein, or a cartridge type recording head having the ink tank integrally provided for the recording head itself.

Also, it is preferable to add a recovery means, preliminary auxiliary means, and the like provided for the recording head as constituents of the recording apparatus of the present invention because with these constituents, the effect of the present invention becomes more stable. To mention specifically, these constituents are a capping means for the recording head, cleaning means, compression or suction means, electrothermal converter or thermal element independent thereof or preliminary heating means provided by the combination thereof, and others. Also, it is effective to provide a preliminary discharging mode which performs preliminary discharging besides the recording.

Further, as a recording mode of the recording apparatus, the present invention is extremely effective in a recording apparatus which is provided with the recording head formed integrally or by a combination of a plurality of heads for recoloring with different colors as described in the aforesaid embodiments or at least one for full-color by mixing colors besides a recording mode for one major color such as black.

In the embodiments of the present invention set forth above, the description has been made of the ink which is a liquid, it may be possible to use the ink which is solidified at room temperature or less if only such ink can be softened at the room temperature or such ink is liquid, or if only such ink can be liquefied when a recording signal for use is applied because in general in the above-mentioned ink jet method, a temperature control is performed to enable the viscosity of ink to be in a stable discharging range by adjusting the temperature of ink itself within a range of 30° C. to 70° C.

Furthermore, the present invention is applicable to the use of the ink having such property as being liquefied only when a thermal energy is given thereto by preventing any positive use of energy for the change of state of ink, from solid to liquid, by the temperature rise due to thermal energy, or using an ink which is solidified when it is left unused for the purpose of preventing its evaporation; in any case, such ink is capable of liquifying itself as liquid ink to be discharged in response to the provision of the recording signal which generates thermal energy, or of beginning to solidify itself already when reaching the recording medium. In the case of using such ink, it may be possible to hold the ink as liquid or solid in porous sheet concavities or through holes facing the electrothermal converter as disclosed in Japanese Patent Laid-Open Application 54-56847 or Japanese Patent Laid-Open Application 60-71260. In the present invention, the most effective method for each ink mentioned above is the type using the above-mentioned film boiling system.

Furthermore, as the mode of the ink jet recording apparatus to which the present invention is applicable, there may be those used for copying machines in combination with readers, and facsimile apparatuses having transmitter and receiver or the like in addition to the image output terminals for a computer or other information processing apparatuses.

What is claimed is:

1. An ink jet recording method for use in a recording apparatus, said apparatus for recording on a recording medium using an ink jet recording head and a detachably mounted fixater device for promoting fixation of an image recorded on the recording medium, said method comprising the steps of:

detecting whether the fixater device is mounted on a mounting section of the recording apparatus;

discriminating whether the recording medium to be recorded is formed of a second material having fixation properties different from fixation properties of a first material; and controlling the recording apparatus so that the image is recorded on the recording medium upon detection that the fixater device is mounted on the mounting section and upon discrimination that the recording medium is formed of the second material and so that the image is not recorded on the recording medium upon detection that the fixater device is mounted on the mounting section and discrimination that the recording medium is not formed of the second material.

2. An ink jet recording method according to claim 1, further comprising the step of mounting the fixater device in place of a cassette for stacking the recording medium.

3. An ink jet recording method according to claim 1, further comprising the step of obtaining a driving power for a conveying section for the fixater device from a driving mechanism of a main body of the recording apparatus.

4. An ink jet recording method according to claim 1, further comprising the step of enabling a paper carrier roller on a downstream side of the recording means of the recording apparatus in a conveying direction of the recording medium to be retracted from a recording surface of the recording medium when it is said detecting step detects that the fixater device is mounted on the mounting section.

5. An ink jet recording method according to claim 1, further comprising the step of discharging ink from a discharging port by utilizing a change of state which is generated by the growth of a bubble resulting from film boiling caused by thermal energy generated by an electrothermal converter.

6. An ink jet recording method according to claim 1, wherein the recording medium formed of the second material is an OHP sheet.

7. An ink jet recording method for use in a recording apparatus, said apparatus for recording on a recording medium using an ink et recording head and a detachably mounted fixater device for promoting fixation of an image recorded on the recording medium, said method comprising the steps of:

inputting information prior to recording as to whether a recording medium formed of a second material having fixation properties different from fixation properties of a first material is to be used as the recording medium;

detecting whether the fixater device is mounted on a mounting section of the recording apparatus;

discriminating whether the recording medium to be recorded is formed of the second material; and controlling the recording apparatus so that the image is recorded on the recording medium formed of the second material regardless of the detected results from said detecting step when the information as to whether the recording medium formed of the second material is to be used as the recording medium is inputted in said inputting step and said discriminating step discriminates that the recording medium is formed of the second material.

8. An ink jet recording method according to claim 7, further comprising the step of mounting the fixater device in place of a cassette for stacking the recording medium.

9. An ink jet recording method according to claim 7, further comprising the step of obtaining a driving power for a conveying section of the fixater device from a driving mechanism of a main body of the recording apparatus.

10. An ink jet recording method according to claim 7, further comprising the step of enabling a paper carrier roller on a downstream side of the recording means of the recording apparatus in a conveying direction of the recording medium to be retracted from a recording surface of the recording medium when said detecting step detects that the fixater device is mounted on the mounting section.

11. An ink jet recording method according to claim 7, further comprising the step of discharging ink from a discharging port by utilizing a change of state which is generated by growth of a bubble resulting from film boiling caused by thermal energy generated by an electrothermal converter.

12. An ink jet recording method according to claim 7, wherein the recording medium formed of the second material is an OHP sheet.

13. An ink jet recording method for a recording apparatus, said apparatus using an ink jet recording head for recording on a recording medium and a detachably mounted fixater device, said fixater device having a fixating section for promoting fixation of an image recorded on the recording medium and a conveying section for conveying the recording medium, said apparatus including a stacking member for stacking the recording medium, said method comprising the steps of:

mounting the fixater device in place of the stacking member for stacking the recording medium;

detecting a rear end of the recording medium which has been recorded; and controlling a drive condition of one of the fixating section and the conveying section of the fixater device in response to a detected result of said detecting step so as to improve a fixation efficiency of the fixater device.

14. An ink jet recording method for a recording apparatus having a main body, said apparatus using an ink jet recording head for recording on a recording-medium and a detachably mounted fixater device, said fixater device having a fixating section for promoting fixation of an image recorded on the recording medium and a conveying section for conveying the recording medium, said apparatus including a driving section, said method comprising the steps of:

detecting a rear end of the recording medium which has been recorded;

obtaining a driving power for the conveying section of the fixater device from the driving section of the main body of the recording apparatus; and controlling a drive condition of one of the fixating section and the conveying section of the fixater device in response to a detected result of said detecting step so as to improve a fixation efficiency of the fixater device.

15. An ink jet recording method for a recording apparatus, said apparatus using an ink jet recording head for recording on a recording medium and a detachably mounted fixater device, said fixater device having a fixating section for promoting fixation of an image recorded on the recording medium and a conveying section for conveying the recording medium, said method comprising the steps of:

enabling a paper carrier roller on a downstream side of the recording head of the recording apparatus in a conveying direction of the recording medium to be retracted from a recording surface of the recording medium when the fixater device is mounted in the recording apparatus;

detecting a rear end of the recording medium which has been recorded; and controlling a drive condition of one of the fixating section and the conveying section of the fixater device in response to detected results of said detecting step so as to improve a fixation efficiency of the fixater device.

16. An ink jet recording method according to any one of claims 13–15, wherein in said controlling step, driving conditions of the fixater device are controlled to increase a fixing energy at a time of executing a fixation process for the rear end of the recording medium.

17. An ink jet recording method according to any one of claims 13–15, further comprising the step of discharging ink from a discharging port by utilizing a change of state which is generated by growth of a bubble resulting from film boiling caused by thermal energy applied by an electrothermal converter.

18. A fixater for use in a recording apparatus having a main body, said fixater comprising:

a fixing unit for expediting fixation of an image provided on a recording medium;

a conveying unit for conveying the recording medium by said fixing unit;

a coupling unit detachably mountable in a mounting section of the recording apparatus for receiving a cassette for stacking the recording medium, wherein said coupling unit of said fixater is mountable in the mounting section in place of the cassette for stacking the recording medium; and a driving power transmission mechanism provided in said coupling unit for obtaining a driving power for said conveying unit from a driving mechanism of the main body of the recording apparatus.

19. A fixater for use in a recording apparatus, said fixater comprising:

a fixing unit for expediting fixation of an image provided on a recording medium;

a conveying unit for conveying the recording medium by said fixing unit;

a coupling unit detachably mountable in a mounting section of the recording apparatus for receiving a cassette for stacking the recording medium, wherein said coupling unit of said fixater is mountable in the mounting section in place of the cassette for stacking the recording medium; and a butting portion for enabling a paper exhaust roller on a downstream side of a recording unit of the recording apparatus in a conveying direction of the recording medium to be retracted from a recording surface of the recording medium when said coupling unit of said fixater is mounted in the mounting section of the recording apparatus.

20. A fixater according to claim 18 or 19, further comprising a guide which is used for manual sheet insertion for conveying a manually inserted sheet.

21. An image recording apparatus for recording on a recording medium with a recording head, said apparatus comprising:

a mounting section for mounting a fixater mechanism, said fixater mechanism having a fixating section for promoting fixation of an image recorded on the recording medium and a conveying section for conveying the recording medium, said mounting section being further for mounting a recording medium loading member for loading the recording medium in place of said fixater mechanism; and a driving mechanism provided on said mounting section to drive said fixater mechanism.

22. A recording apparatus according to claim 21, further comprising:

a paper exhaust roller arranged on a downstream side of the recording head in a conveying direction of the recording medium; and a retracting mechanism for enabling said paper exhaust roller to be selectively retracted to a position at which said roller is not in contact with a surface of the recording medium; wherein said retracting mechanism is driven to cause said paper exhaust roller to be retracted when said fixater mechanism is mounted in said mounting section.

23. A recording apparatus according to claim 21, wherein the recording head comprises an ink jet head for discharging ink by utilizing thermal energy generated by an electrothermal converter.

24. A recording apparatus according to claim 23, wherein the recording head discharges ink from a discharging port by utilizing a change of state which is generated by the growth of a bubble resulting from film boiling caused by the thermal energy applied by said electrothermal converter.

25. An ink jet recording apparatus for recording on a recording medium using an ink jet recording head mounted thereon, said apparatus comprising:

a head mounting section for mounting the ink jet recording head;

a mounting section for mounting a fixater device, said fixater device having a fixating section for promoting fixation of an image recorded on the recording medium and a conveying section for conveying the recording medium;

a detecting section interconnected with said mounting section for detecting whether said fixater device is mounted on said mounting section;

a discriminating section for discriminating whether the recording medium is formed of a second material having fixation properties different from fixation properties of a first material; and a control section communicating with said detecting section and said discriminating section for controlling the ink jet recording head so that the image is recorded on the recording medium when said detecting section detects that said fixater device is mounted on said mounting section and said discriminating section discriminates that the recording medium is formed of the second material and the image is not recorded on the recording medium when said detecting section detects that said fixater device is mounted on said mounting section and said discriminating section discriminates that the recording medium is not formed of the second material.

26. An ink jet recording apparatus according to claim 25, wherein said fixater device is mountable in said mounting section in place of a cassette for stacking the recording medium.

27. An ink jet recording apparatus according to claim 25, wherein said fixater device has a driving power transmission section for obtaining a driving power for said conveying section for fixation from a driving section of a main body of said recording apparatus.

28. An ink jet recording apparatus according to claim 25, herein said fixater device has a butting portion for enabling a paper carrier roller on a downstream side of the recording head of said recording apparatus in a conveying direction of the recording medium to be retracted from a recording surface of the recording medium when the fixater device is mounted in said recording apparatus.

29. An ink jet recording apparatus according to claim 25, wherein the recording head includes an electrothermal converter for generating thermal energy for enabling ink to be discharged from a discharging port.

30. An ink jet recording apparatus according to claim 29, wherein the recording head discharges ink from the discharging port by utilizing a change of state which is generated by the growth of a bubble resulting from film boiling by the thermal energy applied by said electrothermal converter.

31. An ink jet recording apparatus according to claim 25, wherein the recording medium formed of the second material is an OHP sheet.

32. An ink jet recording apparatus for recording on a recording medium using an ink jet recording head mounted thereon, said apparatus comprising:

a head mounting section for mounting the ink jet recording head;

a mounting section for mounting a fixater device, said fixater device having a fixing section for promoting fixation of an image recorded on the recording medium and a conveying section for conveying the recording medium;

an input section to which information as to whether a recording medium formed of a second material having fixation properties different from fixation properties of a first material is to be used as the recording medium is inputted prior to recording;

a detecting section interconnected with said mounting section for detecting whether said fixater device is mounted on said mounting section;

a discriminating section for discriminating whether the recording medium is formed of the second material; and a control section communicating with said input section, said detecting section and said discriminating section for controlling the recording head so that the image is recorded on the recording medium formed of the second material regardless of a detected result of said detecting section when the information as to whether the second material is used as the recording medium is inputted to said input section and said discriminating section discriminates that the recording medium is the second material.

33. An ink jet recording apparatus according to claim 32, wherein said fixater device is mountable in said mounting section in place of a cassette for stacking the recording medium.

34. An ink jet recording apparatus according to claim 32, wherein said fixater device has driving power transmission section for obtaining a driving power for said conveying section for fixation from a driving section of a main body of said recording apparatus.

35. An ink jet recording apparatus according to claim 32, wherein said fixater device has a butting portion for enabling a paper carrier roller on downstream side of the recording head of said recording apparatus in a conveying direction of the recording medium to be retracted from a recording surface of the recording medium when said fixater device is mounted in the recording apparatus.

36. An ink jet recording apparatus according to claim 32, wherein the recording head includes an electrothermal converter for generating thermal energy for enabling ink to be discharged from a discharging port.

37. An ink jet recording apparatus according to claim 36, wherein the recording head discharges ink from the discharging port by utilizing a change of state which is generated by the growth of a bubble resulting from film boiling caused by the thermal energy applied by said electrothermal converter.

38. An ink jet recording apparatus according to claim 32, wherein the recording medium formed of the second material is an OHP sheet.

39. An ink jet recording apparatus for recording on a recording medium using an ink jet recording head mounted thereon, said apparatus comprising:

a head mounting section for mounting the ink jet recording head;

a mounting section for mounting a fixater device, said fixater device having a fixating section for promoting fixation of an image recorded on the recording medium and a conveying section for conveying the recording medium by said fixater device;

a conveying section for conveying the recording medium to and from a recording area for recording by the recording head and to said fixater device;

a detecting section for detecting a rear end of the recording medium; and a controlling section communicating with said detecting section for controlling a drive condition of one of said fixating section and said conveying section of said fixater device in response to a detected result of said detecting section so as to improve a fixation efficiency of said fixater device, wherein said fixater device is mountable in said mounting section in place of a stacking member for stacking the recording medium.

40. An ink jet recording apparatus for recording on a recording medium using an ink jet recording head mounted thereon, said apparatus comprising:

a head mounting section for mounting the ink jet recording head;

a mounting section for mounting a fixater device, said fixater device having a fixating section for promoting fixation of an image recorded on the recording medium and a conveying section for conveying the recording medium by said fixater device;

a conveying section for conveying the recording medium to and from a recording area for recording by the recording head and to said fixater device;

a detecting section for detecting a rear end of the recording medium; and a controlling section communicating with said detecting section for controlling a drive condition of one of said fixating section and said conveying section of said fixater device in response to a detected result of said detecting section so as to improve a fixation efficiency of said fixater device, wherein said fixater device comprises a driving power transmission mechanism for obtaining a driving power for said conveying section from a driving section of a main body of said recording apparatus.

41. An ink jet recording apparatus for recording on a recording medium using an ink jet recording head mounted thereon, said apparatus comprising:

a head mounting section for mounting the ink jet recording head;

a mounting section for mounting a fixater device, said fixater device having a fixating section for promoting fixation of an image recorded on the recording medium and a conveying section for conveying the recording medium by said fixater device;

a conveying section for conveying the recording medium to and from a recording area for recording by the recording head and to said fixater device;

a detecting section for detecting a rear end of the recording medium; and a controlling section communicating with said detecting section for controlling a drive condition of one of said fixating section and said conveying section of said fixater device in response to a detected result of said detecting section so as to improve a fixation efficiency of said fixater device, wherein said fixater device comprises a roller retracting drive portion for enabling a paper carrier roller on a downstream side of the recording head of said recording apparatus in a conveying direction of the recording medium to be retracted from a recording surface of the recording medium in accordance with mounting of said fixater device on the recording apparatus.

42. An ink jet recording apparatus for recording on a recording medium using an ink jet recording head mounted thereon, said apparatus comprising:

a head mounting section for mounting the ink jet recording head;

a mounting section for mounting a fixater device, said fixater device having a fixating section for promoting fixation of an image recorded on the recording medium and a conveying section for conveying the recording medium by said fixater device;

a conveying section for conveying the recording medium to and from a recording area for recording by the recording head and to said fixater device;

a detecting section for detecting a rear end of the recording medium; and a controlling section communicating with said detecting section for controlling a drive condition of one of said fixating section and said conveying section of said fixater device in response to a detected result of said detecting section so as to improve a fixation efficiency of said fixater device, wherein said controlling section controls a driving condition of said fixater device to increase a fixing energy at a time of executing a fixation process for the rear end of the recording medium.

43. An ink jet recording apparatus according to any one of claims 39–42, wherein the recording head includes an electrothermal converter for generating thermal energy for enabling ink to be discharged from a discharging port.

44. An ink jet recording apparatus according to claim 43, wherein the recording head discharges ink from the discharging port by utilizing a change of state which is generated by the growth of a bubble resulting from film boiling caused by the thermal energy applied by said electrothermal converter.

45. A fixater for use in a recording apparatus having a main body, said fixater comprising:

a fixing unit for expediting fixation of an image provided on a recording medium;

a conveying unit for conveying the recording medium by said fixing unit;

a coupling unit detachably mountable in a mounting section of the recording apparatus for receiving a support member for mountably supporting the recording medium, wherein said coupling unit of said fixater is mountable in the mounting section in place of the support member for mountably supporting the recording medium; and a driving power transmission section provided in said coupling unit for obtaining a driving power for said conveying unit from a driving section of the main body of the recording apparatus.

46. A fixater for use in a recording apparatus, said fixater comprising:

a fixing unit for expediting fixation of an image provided on a recording medium;

a conveying unit for conveying the recording medium by said fixing unit;

a coupling unit detachably mountable in a mounting section of the recording apparatus for receiving a support member for mountably supporting the recording medium, wherein said coupling unit of said fixater is mountable in the mounting section in place of the support member for mountably supporting the recording medium; and a roller retracting drive portion for enabling a paper exhaust roller on a downstream side of a recording unit of the recording apparatus in a conveying direction of the recording medium to be retracted from a recording surface of the recording medium in accordance with mounting of said coupling unit of said fixater on the mounting section of the recording apparatus.

47. An ink jet recording apparatus for recording on a recording medium using an ink jet recording head mounted thereon, said apparatus comprising:

a head mounting section for mounting the ink jet recording head;

a mounting section for mounting a fixater device said fixater device having a fixating section for promoting fixation of an image recorded on the recording medium and a conveying section for conveying the recording medium;

a detecting section interconnected with said mounting section for detecting whether said fixater device is mounted on said mounting section;

a discriminating section for discriminating whether fixation properties of the recording medium are first fixation properties or second fixation properties different from the first fixation properties; and a control section communicating with said detecting section and said discriminating section for controlling the ink jet recording head so that the image is recorded on the recording medium when said detecting section detects that said fixater device is mounted on said mounting section and said discriminating section discriminates that the fixation properties of the recording medium are the second fixation properties.

48. An apparatus according to claim 47, wherein the recording medium having the second fixation properties is an OHP sheet.

49. An ink jet recording apparatus for recording on a recording medium using an ink jet recording head mounted thereon, said apparatus comprising:

a head mounting section for mounting the ink jet recording head;

a mounting section for mounting a fixater device, said fixater device having a fixing section for promoting fixation of an image recorded on the recording medium and a conveying section for conveying the recording medium;

a detecting section interconnected with said mounting section for detecting whether said fixater device is mounted on said mounting section;

a discriminating section for discriminating whether fixation properties of the recording medium are first fixation properties or second fixation properties different from the first fixation properties; and a control section communicating with said detecting section and said discriminating section for controlling the recording head so that the image is recorded on the recording medium having the second fixation properties regardless of a detected result of said detecting section when said discriminating section discriminates that the fixation properties of the recording medium are the second fixation properties.

50. An apparatus according to claim 49, wherein the recording medium having the second fixation properties is an OHP sheet.

51. An ink jet recording method for use in a recording apparatus, said apparatus for recording on a recording medium using an ink jet recording head and a detachably mounted fixater device for promoting fixation of an image recorded on the recording medium, said method comprising the steps of:

detecting whether the fixater device is mounted on a mounting section of the recording apparatus;

discriminating whether fixation properties of the recording medium to be recorded are first fixation properties or second fixation properties different from the first fixation properties; and controlling the recording apparatus so that the image is recorded on the recording medium upon detection that the fixater device is mounted on the mounting section and upon discrimination of the recording medium having the second fixation properties.

52. A method according to claim 51, wherein the recording medium having the second fixation properties is an OHP sheet.

53. An ink jet recording method for use in a recording apparatus, said apparatus for recording on a recording medium using an ink jet recording head and a detachably mounted fixater device for promoting fixation of an image recorded on the recording medium, said method comprising the steps of:

detecting whether the fixater device is mounted on a mounting section of the recording apparatus;

discriminating whether fixation properties of the recording medium to be recorded are first fixation properties or second fixation properties different from the first fixation properties; and controlling the recording apparatus so that the image is recorded on the recording medium having the second fixation properties regardless of the detected results from said detecting step when said discriminating step discriminates that the fixation properties of the recording medium are the second fixation properties.

54. A method according to claim 53, wherein the recording medium having the second fixation properties is an OHP sheet.

* * * * *

UNITED STATES PATENT AND TRADEMARK OFFICE

CERTIFICATE OF CORRECTION

PATENT NO. : 5,502,464 Page 1 of 3

DATED : March 26, 1996

INVENTOR(S) : Kazuyoshi TAKAHASHI, et al.

It is certified that error appears in the above-indentified patent and that said Letters Patent is hereby corrected as shown below:

COLUMN 2:

Line 21, "0.5-2.0)" should read --0.5-2.0 mm)--.

COLUMN 5:

Line 50, "he" should read --the--;
Line 66, "he" should read --the--.

COLUMN 7:

Line 59, "bubble" should read --a bubble--.

COLUMN 14:

Line 52, "he" should read --the--.

UNITED STATES PATENT AND TRADEMARK OFFICE

CERTIFICATE OF CORRECTION

PATENT NO. : 5,502,464

DATED : March 26, 1996

INVENTOR(S) : Kazuyoshi TAKAHASHI, et al.

It is certified that error appears in the above-indentified patent and that said Letters Patent is hereby corrected as shown below:

COLUMN 16:

Line 1, "he" should read --the--.

COLUMN 29:

Line 1, "it is" should be deleted;
Line 13, "ink et" should read --ink jet--.

COLUMN 30:

Line 9, "recording-medium" should read --recording medium--.

UNITED STATES PATENT AND TRADEMARK OFFICE

CERTIFICATE OF CORRECTION

PATENT NO. : 5,502,464 Page 3 of 3

DATED : March 26, 1996

INVENTOR(S) : Kazuyoshi TAKAHASHI, et al.

It is certified that error appears in the above-indentified patent and that said Letters Patent is hereby corrected as shown below:

COLUMN 32:

Line 36, "herein" should read --wherein--.

COLUMN 33:

Line 24, "driving" should read --a driving--.

Signed and Sealed this

Tenth Day of September, 1996

*Attest:*

Bruce Lehman

BRUCE LEHMAN

*Attesting Officer*

*Commissioner of Patents and Trademarks*